US010598013B2

(12) United States Patent
Sollami

(10) Patent No.: US 10,598,013 B2
(45) **Date of Patent: *Mar. 24, 2020**

(54) BIT HOLDER WITH SHORTENED NOSE PORTION

(71) Applicant: The Sollami Company, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/181,591

(22) Filed: Nov. 6, 2018

(65) Prior Publication Data

US 2019/0242254 A1 Aug. 8, 2019

Related U.S. Application Data

(63) Continuation-in-part of application No. 15/708,292, filed on Sep. 19, 2017, which is a continuation of application No. 14/628,482, filed on Feb. 23, 2015, now Pat. No. 9,879,531, application No. 16/181,591, which is a continuation-in-part of application No.
(Continued)

(51) Int. Cl.
*E21C 35/18* (2006.01)
*E21C 35/197* (2006.01)

(52) U.S. Cl.
CPC ..... *E21C 35/18* (2013.01); *E21C 35/197* (2013.01); *E21C 2035/1826* (2013.01)

(58) Field of Classification Search
CPC ..... E21C 35/19; B28D 1/188
See application file for complete search history.

(56) References Cited

U.S. PATENT DOCUMENTS 2,382,947 A 7/1944 Brozek
3,342,532 A 9/1967 Krekeler
(Continued)

FOREIGN PATENT DOCUMENTS

DE 102004049710 4/2006
DE 102011079115 1/2013
(Continued)

*Primary Examiner* — Janine M Kreck
(74) *Attorney, Agent, or Firm* — Mercedes V. O'Connor; Rockman Videbeck & O'Connor

(57) ABSTRACT

A bit holder that includes a front portion and a shank axially depending from the front portion. The front portion having an axial length that is less than the axial length of the shank. A combination bit holder and base block that includes the bit holder with the front portion having an axial length that is less than the axial length of the shank. The base block including a mounting portion and a device receiving portion, the device receiving portion including a length that is the same or less than a length of the mounting portion. The base block having a device receiving portion that includes a length shorter than a length of the mounting portion adapted to provide increased access to the rear of the bit assembly allowing the base blocks to be mounted closer to each other for micro-milling operations. Shortened bit holder shanks are reconfigured from prior art to provide increased holding power between the bit holder shank and base block bore.

41 Claims, 18 Drawing Sheets

Related U.S. Application Data

14/690,679, filed on Apr. 20, 2015, now Pat. No. 10,370,966, and a continuation-in-part of application No. 15/928,269, filed on Mar. 22, 2018, now Pat. No. 10,385,689, which is a continuation-in-part of application No. 14/512,581, filed on Oct. 13, 2014, now Pat. No. 10,072,501, which is a continuation-in-part of application No. 12/870,289, filed on Aug. 27, 2010, now Pat. No. 8,622,482.

(60) Provisional application No. 61/944,676, filed on Feb. 26, 2014, provisional application No. 61/983,291, filed on Apr. 23, 2014, provisional application No. 61/891,683, filed on Oct. 16, 2013.

(56) References Cited

U.S. PATENT DOCUMENTS

| | | | |
|---|---|---|---|
| 3,397,012 | A | 8/1968 | Krekeler |
| 3,476,438 | A | 11/1969 | Bower, Jr. |
| 3,519,309 | A | 7/1970 | Engle |
| 3,833,264 | A | 9/1974 | Elders |
| 3,833,265 | A | 9/1974 | Elders |
| 3,865,437 | A | 2/1975 | Crosby |
| 4,084,856 | A | 4/1978 | Emmerich |
| 4,247,150 | A | 1/1981 | Wrulich et al. |
| RE30,807 | E | 12/1981 | Elders |
| 4,310,939 | A | 1/1982 | Iijima |
| 4,453,775 | A | 6/1984 | Clemmow |
| 4,478,298 | A | 10/1984 | Hake |
| 4,489,986 | A | 12/1984 | Dziak |
| 4,525,178 | A | 6/1985 | Hall |
| 4,561,698 | A | 12/1985 | Beebe |
| 4,570,726 | A | 2/1986 | Hall |
| 4,604,106 | A | 8/1986 | Hall |
| 4,632,463 | A | 12/1986 | Sterwerf, Jr. |
| 4,694,918 | A | 9/1987 | Hall |
| 4,702,525 | A | 10/1987 | Sollami |
| 4,763,956 | A | 8/1988 | Emmerich |
| 4,811,801 | A | 3/1989 | Salesky |
| 4,818,027 | A | 4/1989 | Simon |
| 4,821,819 | A | 4/1989 | Whysong |
| 4,844,550 | A | 7/1989 | Beebe |
| 4,915,455 | A | 4/1990 | O'Niell |
| 4,944,559 | A | 7/1990 | Sionett |
| 5,067,775 | A | 11/1991 | D'Angelo |
| 5,088,797 | A | 2/1992 | O'Neill |
| 5,098,167 | A | 3/1992 | Latham |
| 5,159,233 | A | 10/1992 | Sponseller |
| 5,161,627 | A | 11/1992 | Burkett |
| 5,273,343 | A | 12/1993 | Ojanen |
| 5,287,937 | A | 2/1994 | Sollami |
| 5,302,005 | A | 4/1994 | O'Neill |
| 5,303,984 | A | 4/1994 | Ojanen |
| 5,352,079 | A | 10/1994 | Croskey |
| 5,370,448 | A | 12/1994 | Sterwerf, Jr. |
| 5,374,111 | A | 12/1994 | Den Besten |
| 5,415,462 | A | 5/1995 | Massa |
| 5,417,475 | A | 5/1995 | Graham et al. |
| 5,458,210 | A | 10/1995 | Sollami |
| 5,484,191 | A | 1/1996 | Sollami |
| 5,492,188 | A | 2/1996 | Smith et al. |
| 5,551,760 | A | 9/1996 | Sollami |
| 5,607,206 | A | 3/1997 | Siddle |
| 5,628,549 | A | 5/1997 | Ritchey |
| 5,720,528 | A | 2/1998 | Ritchey |
| 5,725,283 | A | 3/1998 | O'Neill |
| 5,823,632 | A | 10/1998 | Burkett |
| 5,924,501 | A | 7/1999 | Tibbitts |
| 5,931,542 | A | 8/1999 | Britzke |
| 5,934,854 | A | 8/1999 | Krautkremer et al. |
| 5,992,405 | A | 11/1999 | Sollami |
| D420,013 | S | 2/2000 | Warren |
| 6,019,434 | A | 2/2000 | Emmerich |
| 6,102,486 | A | 8/2000 | Briese |
| 6,176,552 | B1 | 1/2001 | Topka, Jr. |
| 6,196,340 | B1 | 3/2001 | Jensen et al. |
| 6,199,451 | B1 | 3/2001 | Sollami |
| 6,250,535 | B1 | 6/2001 | Sollami |
| 6,331,035 | B1 | 12/2001 | Montgomery, Jr. |
| 6,341,823 | B1 | 1/2002 | Sollami |
| 6,357,832 | B1 | 3/2002 | Sollami |
| 6,371,567 | B1 | 4/2002 | Sollami |
| 6,382,733 | B1 | 5/2002 | Parrott |
| 6,428,110 | B1 | 8/2002 | Ritchey et al. |
| 6,508,516 | B1 | 1/2003 | Kammerer |
| D471,211 | S | 3/2003 | Sollami |
| 6,585,326 | B2 | 7/2003 | Sollami |
| 6,685,273 | B1 | 2/2004 | Sollami |
| 6,692,083 | B2 | 2/2004 | Latham |
| D488,170 | S | 4/2004 | Sollami |
| 6,733,087 | B2 | 5/2004 | Hall |
| 6,739,327 | B2 | 5/2004 | Sollami |
| 6,786,557 | B2 | 9/2004 | Montgomery |
| 6,824,225 | B2 | 11/2004 | Stiffler |
| 6,846,045 | B2 | 1/2005 | Sollami |
| 6,854,810 | B2 | 2/2005 | Montgomery |
| 6,866,343 | B2 | 3/2005 | Holl et al. |
| 6,968,912 | B2 | 11/2005 | Sollami |
| 6,994,404 | B1 | 2/2006 | Sollami |
| 7,097,258 | B2 | 8/2006 | Sollami |
| 7,118,181 | B2 | 10/2006 | Frear |
| 7,150,505 | B2 | 12/2006 | Sollami |
| 7,195,321 | B1 | 3/2007 | Sollami |
| 7,210,744 | B2 | 5/2007 | Montgomery |
| 7,229,136 | B2 | 6/2007 | Sollami |
| 7,234,782 | B2 | 6/2007 | Stehney |
| D554,162 | S | 10/2007 | Hall |
| 7,320,505 | B1 | 1/2008 | Hall |
| 7,338,135 | B1 | 3/2008 | Hall |
| 7,347,292 | B1 | 3/2008 | Hall |
| D566,137 | S | 4/2008 | Hall |
| 7,353,893 | B1 | 4/2008 | Hall |
| 7,384,105 | B2 | 6/2008 | Hall |
| 7,396,086 | B1 | 6/2008 | Hall |
| 7,401,862 | B2 | 7/2008 | Holl et al. |
| 7,401,863 | B1 | 7/2008 | Hall |
| 7,410,221 | B2 | 8/2008 | Hall |
| 7,413,256 | B2 | 8/2008 | Hall |
| 7,413,258 | B2 | 8/2008 | Hall |
| 7,419,224 | B2 | 9/2008 | Hall |
| 7,445,294 | B2 | 11/2008 | Hall |
| D581,952 | S | 12/2008 | Hall |
| 7,464,993 | B2 | 12/2008 | Hall |
| 7,469,756 | B2 | 12/2008 | Hall |
| 7,469,971 | B2 | 12/2008 | Hall |
| 7,469,972 | B2 | 12/2008 | Hall |
| 7,475,948 | B2 | 1/2009 | Hall |
| 7,523,794 | B2 | 4/2009 | Hall |
| 7,568,770 | B2 | 8/2009 | Hall |
| 7,569,249 | B2 | 8/2009 | Hall |
| 7,571,782 | B2 | 8/2009 | Hall |
| 7,575,425 | B2 | 8/2009 | Hall |
| 7,588,102 | B2 | 9/2009 | Hall |
| 7,594,703 | B2 | 9/2009 | Hall |
| 7,600,544 | B1 | 10/2009 | Sollami |
| 7,600,823 | B2 | 10/2009 | Hall |
| 7,628,233 | B1 | 12/2009 | Hall |
| 7,635,168 | B2 | 12/2009 | Hall |
| 7,637,574 | B2 | 12/2009 | Hall |
| 7,648,210 | B2 | 1/2010 | Hall |
| 7,665,552 | B2 | 2/2010 | Hall |
| 7,669,938 | B2 | 3/2010 | Hall |
| 7,681,338 | B2 | 3/2010 | Hall |
| 7,712,693 | B2 | 5/2010 | Hall |
| 7,717,365 | B2 | 5/2010 | Hall |
| 7,722,127 | B2 | 5/2010 | Hall |
| 7,789,468 | B2 | 9/2010 | Sollami |
| 7,832,808 | B2 | 11/2010 | Hall |
| 7,883,155 | B2 | 2/2011 | Sollami |
| 7,950,745 | B2 | 5/2011 | Sollami |
| 7,963,617 | B2 | 6/2011 | Hall |
| 3,007,049 | A1 | 8/2011 | Fader |
| 7,992,944 | B2 | 8/2011 | Hall |

(56) References Cited

U.S. PATENT DOCUMENTS

| | | | | |
|---|---|---|---|---|
| 7,992,945 | B2 | 8/2011 | Hall | |
| 7,997,660 | B2 | 8/2011 | Monyak et al. | |
| 7,997,661 | B2 | 8/2011 | Hall | |
| 8,007,051 | B2 | 8/2011 | Hall | |
| 8,029,068 | B2 | 10/2011 | Hall | |
| 8,033,615 | B2 | 10/2011 | Hall | |
| 8,033,616 | B2 | 10/2011 | Hall | |
| 8,038,223 | B2 | 10/2011 | Hall | |
| 8,061,784 | B2 | 11/2011 | Hall | |
| 8,109,349 | B2 | 2/2012 | Hall | |
| 8,118,371 | B2 | 2/2012 | Hall | |
| 8,136,887 | B2 | 3/2012 | Hall | |
| 8,201,892 | B2 * | 6/2012 | Hall | E21C 35/183 299/102 |
| 8,215,420 | B2 | 7/2012 | Hall | |
| 8,292,372 | B2 | 10/2012 | Hall | |
| 8,414,085 | B2 | 4/2013 | Hall | |
| 8,449,039 | B2 | 5/2013 | Hall | |
| 8,485,609 | B2 | 7/2013 | Hall | |
| 8,500,209 | B2 | 8/2013 | Hall | |
| 8,540,320 | B2 | 9/2013 | Sollami | |
| RE44,690 | E | 1/2014 | Sollami | |
| 8,622,482 | B2 | 1/2014 | Sollami | |
| 8,622,483 | B2 | 1/2014 | Sollami | |
| 8,646,848 | B2 | 2/2014 | Hall | |
| 8,728,382 | B2 | 5/2014 | Hall | |
| 8,740,314 | B2 | 6/2014 | O'Neill | |
| 9,004,610 | B2 | 4/2015 | Erdmann et al. | |
| 9,028,008 | B1 | 5/2015 | Bookhamer | |
| 9,039,099 | B2 | 5/2015 | Sollami | |
| 9,316,061 | B2 | 4/2016 | Hall | |
| 9,879,531 | B2 * | 1/2018 | Sollami | E21C 35/18 |
| 9,909,416 | B1 | 3/2018 | Sollami | |
| 10,337,324 | B2 * | 7/2019 | Sollami | E21C 35/19 |
| 2002/0074850 | A1 | 6/2002 | Montgomery, Jr. | |
| 2002/0074851 | A1 | 6/2002 | Montgomery, Jr. | |
| 2002/0109395 | A1 | 8/2002 | Sollami | |
| 2002/0167216 | A1 | 11/2002 | Sollami | |
| 2002/0192025 | A1 | 12/2002 | Johnson | |
| 2003/0015907 | A1 | 1/2003 | Sollami | |
| 2003/0047985 | A1 | 3/2003 | Stiffler | |
| 2003/0052530 | A1 | 3/2003 | Sollami | |
| 2003/0122414 | A1 | 7/2003 | Sollami | |
| 2003/0209366 | A1 | 11/2003 | McAlvain | |
| 2004/0004389 | A1 | 1/2004 | Latham | |
| 2004/0174065 | A1 | 9/2004 | Sollami | |
| 2005/0212345 | A1 | 9/2005 | Sleep et al. | |
| 2006/0071538 | A1 | 4/2006 | Sollami | |
| 2006/0186724 | A1 | 8/2006 | Stehney | |
| 2006/0238015 | A1 * | 10/2006 | Sollami | B28D 1/188 299/106 |
| 2006/0261663 | A1 | 11/2006 | Sollami | |
| 2007/0013224 | A1 | 1/2007 | Stehney | |
| 2007/0040442 | A1 | 2/2007 | Weaver | |
| 2007/0052279 | A1 | 3/2007 | Sollami | |
| 2008/0035386 | A1 | 2/2008 | Hall et al. | |
| 2008/0036276 | A1 | 2/2008 | Hall et al. | |
| 2008/0036283 | A1 | 2/2008 | Hall et al. | |
| 2008/0100124 | A1 | 5/2008 | Hall et al. | |
| 2008/0145686 | A1 | 6/2008 | Mirchandani | |
| 2008/0164747 | A1 | 7/2008 | Weaver et al. | |
| 2008/0284234 | A1 | 11/2008 | Hall et al. | |
| 2009/0146491 | A1 | 6/2009 | Fader et al. | |
| 2009/0160238 | A1 | 6/2009 | Hall et al. | |
| 2009/0256413 | A1 | 10/2009 | Majagi | |
| 2009/0261646 | A1 | 10/2009 | Ritchie et al. | |
| 2010/0045094 | A1 | 2/2010 | Sollami | |
| 2010/0244545 | A1 | 9/2010 | Hall | |
| 2010/0253130 | A1 | 10/2010 | Sollami | |
| 2010/0320003 | A1 | 12/2010 | Sollami | |
| 2010/0320829 | A1 | 12/2010 | Sollami | |
| 2011/0006588 | A1 | 1/2011 | Monyak et al. | |
| 2011/0089747 | A1 | 4/2011 | Helsel | |
| 2011/0175430 | A1 | 7/2011 | Heiderich et al. | |
| 2011/0204703 | A1 | 8/2011 | Sollami | |
| 2011/0254350 | A1 | 10/2011 | Hall | |
| 2012/0001475 | A1 | 1/2012 | Dubay et al. | |
| 2012/0027514 | A1 | 2/2012 | Hall | |
| 2012/0056465 | A1 | 3/2012 | Gerer et al. | |
| 2012/0068527 | A1 | 3/2012 | Erdmann | |
| 2012/0104830 | A1 | 5/2012 | Monyak et al. | |
| 2012/0181845 | A1 | 7/2012 | Sollami | |
| 2012/0242136 | A1 | 9/2012 | Ojanen | |
| 2012/0248663 | A1 | 10/2012 | Hall | |
| 2012/0261977 | A1 | 10/2012 | Hall | |
| 2012/0280559 | A1 | 11/2012 | Watson | |
| 2012/0286559 | A1 | 11/2012 | Sollami | |
| 2012/0319454 | A1 | 12/2012 | Swope | |
| 2013/0169023 | A1 | 7/2013 | Monyak | |
| 2013/0181501 | A1 | 7/2013 | Hall et al. | |
| 2013/0199693 | A1 | 8/2013 | Tank et al. | |
| 2013/0307316 | A1 | 11/2013 | Roetsch et al. | |
| 2014/0035346 | A1 | 2/2014 | Fundakowski et al. | |
| 2014/0110991 | A1 | 4/2014 | Sollami | |
| 2014/0232172 | A1 | 8/2014 | Roth et al. | |
| 2014/0262541 | A1 | 9/2014 | Parsana et al. | |
| 2014/0326516 | A1 | 11/2014 | Haugvaldstad | |
| 2015/0028656 | A1 | 1/2015 | Sollami | |
| 2015/0035343 | A1 | 2/2015 | Ojanen | |
| 2015/0137579 | A1 | 5/2015 | Lachmann et al. | |
| 2015/0198040 | A1 | 7/2015 | Voitic et al. | |
| 2015/0240634 | A1 | 8/2015 | Sollami | |
| 2015/0285074 | A1 | 10/2015 | Sollami | |
| 2015/0292325 | A1 | 10/2015 | Sollami | |
| 2015/0300166 | A1 | 10/2015 | Ries et al. | |
| 2015/0308488 | A1 | 10/2015 | Kahl | |
| 2015/0315910 | A1 | 11/2015 | Sollami | |
| 2015/0354285 | A1 | 12/2015 | Hall | |
| 2016/0102550 | A1 | 4/2016 | Paros et al. | |
| 2016/0194956 | A1 | 7/2016 | Sollami | |
| 2016/0229084 | A1 | 8/2016 | Lehnert | |
| 2016/0237818 | A1 | 8/2016 | Weber | |
| 2017/0089198 | A1 * | 3/2017 | Sollami | E21C 35/183 |
| 2017/0101867 | A1 | 4/2017 | Hall et al. | |

FOREIGN PATENT DOCUMENTS

| | | |
|---|---|---|
| DE | 202012100353 | 6/2013 |
| DE | 102015121953 | 7/2016 |
| DE | 102016118658 | 3/2017 |
| EP | 3214261 | 9/2017 |
| GB | 1114156 | 5/1968 |
| GB | 2483157 | 2/2012 |
| GB | 2534370 | 7/2016 |
| WO | 2008105915 A2 | 9/2008 |
| WO | 2008105915 A3 | 9/2008 |
| WO | 2009006612 | 1/2009 |

* cited by examiner

SECTION B-B

SECTION D-D

SECTION E-E

BIT HOLDER WITH SHORTENED NOSE PORTION

CROSS-REFERENCE TO RELATED APPLICATION(S)

This application claims priority to U.S. Provisional Application No. 61/944,676, filed Feb. 26, 2014, claims priority to and is a continuation-in-part of U.S. Non-provisional application Ser. No. 14/628,482, filed Feb. 23, 2015, now U.S. Pat. No. 9,879,531, issued Jan. 30, 2018, claims priority to and is a continuation-in-part of U.S. Non-provisional application Ser. No. 15/708,292, filed Sep. 19, 2017, claims priority to U.S. Provisional Application No. 61/983,291, filed Apr. 23, 2014, claims priority to and is a continuation-in-part of U.S. Non-provisional application Ser. No. 14/690,679, filed Apr. 20, 2015, claims priority to U.S. Provisional Application No. 61/891,683, filed Oct. 16, 2013, claims priority to and is a continuation-in-part of U.S. Non-provisional application Ser. No. 14/512,581, filed Oct. 13, 2014, now U.S. Pat. No. 10,072,051, issued Sep. 11, 2018, claims priority to and is a continuation-in-part of U.S. Non-provisional application Ser. No. 12/870,289, filed Aug. 27, 2010, now U.S. Pat. No. 8,622,482, issued Jan. 7, 2014, and claims priority to and is a continuation-in-part of U.S. Non-provisional application Ser. No. 15/928,269, filed Mar. 22, 2018, the extent allowed by law and the contents of which are incorporated herein by reference in their entireties.

TECHNICAL FIELD

This disclosure relates to bit assemblies for road milling, mining and trenching machines and, more particularly, to bit holders and/or bit sleeves with a shortened front end.

BACKGROUND

Removing material from the terra firma, whether it be in reconstruction of highways, trenching operations or long wall and other mining operations, has seen numerous improvements in mechanisms to achieve such material removal in recent years. In order to lessen the down time of such material removal machinery, various improvements have been made to bit assemblies, which define the end point at which the machinery separates surface material from the underlayment or ground. This end point where the material removing equipment contacts the surface of the material to be removed is traditionally comprised of a series of bit assemblies that may include bits having a pointed forward end, bit holders in which the bits are mounted or could be made an integral part of, and bit holder blocks in which the base of the bit/bit holder is mounted. The bit holder block is mounted on either an endless chain or chain plate system or a rotatable drum.

Presently, the most common use of this bit assembly is found on the rotatable drum wherein numerous such assemblies are mounted, either in V-shape or spiral form on the drum. Such a recent improvement is found in U.S. Pat. Nos. 6,371,567 and 6,585,326 wherein the bit holder or middle piece of the bit assembly is no longer required to be retained on the bit holder block by a threaded shank with a nut thereon holding the bit holder on the bit holder block. This improvement includes a hollow shank on which the distal end is axially slotted and wherein the shank may be driven into a bore in the bit holder block and the distal end of the shank is compressed radially with a sufficient radial force between the bit holder shank and the bit holder block bore to maintain the bit holder mounted on the bit block during use.

Eliminating a retaining nut or retaining ring from the distal end of the bit holder shank eased the ability to remove the bit holder from the bit holder block through the bottom of the bit holder block. Further, a tungsten carbide tipped bit could be removed from the bit holder by punching same outwardly through the bottom of the bit holder block bore.

Another improvement in bit assemblies has been the introduction of diamond tipped bits or combination bit/holders. The hardened bit tips may be formed of man-made PCD material, or industrial powdered diamond material embedded in a core or base forming a coating on the tip of the bit/holder. With the introduction of this extremely hard material on the tip of the bit cutting assembly, the use of tungsten carbide bits mounted on bit holders which, in turn, are mounted on bit holder blocks, has in some instances given way to a unitary combination bit/bit holder which has a longer in use life than the prior tungsten carbide tipped three piece combination. It should also be noted that, if desired, a diamond tipped bit may also be utilized in conjunction with already existing bit holders and bit blocks.

In the case of tungsten carbide tipped bits, it may be preferred that the bit have the ability to rotate in the bit holder to spread out the wear characteristics of the bit during use. However, the longer use life of diamond tipped surface removal machinery means that the distal tip no longer has to be rotatable.

Another improvement in the material removing process has been not only the use of regular surface milling equipment which has the spiral mounted bit assemblies customarily positioned at ⅝ inch axially center-to-center in spiral or V-shape fashion across the drum, but also the use of micro-milling equipment wherein the bit tip spacing is 0.200 inch center line to center axial spacing between the bits. Micro milling is used not only to remove materials that regular milling achieves, but also to level parts of bumpy surfaces of roads, or remove just the upper portion of the road surface, perhaps an inch or two, to smooth the road surface, or to allow the delaying of resurfacing, thus achieving additional road surface life and saving money.

The use of many more bit assemblies on a single drum, sometimes utilizing about 900 such bit assemblies on a 46-54 inch diameter drum, means that the bit assemblies are mounted on the drum in much closer orientation to each other, thus minimizing the space between the bottom end of one bit holder block and the tip of an adjacent bit holder block. This decrease in adjacent space between bit blocks means that it is even more difficult than previously known to get access to the bottom of the bit holder block in order to drive out the bit holder, or any combination bit/holder from the bit holder block. Structures that increase the adjacent distance between the forward end of bit assemblies and the rear of adjacent bit assemblies provide more room for maintenance personnel to replace bits, holders, or combination bit/holders.

SUMMARY

This disclosure relates generally to bit assemblies for road milling, mining, and trenching equipment. One implementation of the teachings herein is a bit holder that includes a body portion including a body axial length; a generally cylindrical hollow shank axially depending from a bottom of the body portion, the shank including a shank axial length that is longer than the body axial length; and an outer surface of a first portion of the shank adjacent a distal end of the shank being tapered radially outwardly as it extends toward the distal end.

In another implementation of the teachings herein is a combination bit holder and base block that includes a bit holder that includes a body portion including a body axial length; a generally cylindrical hollow shank axially depending from a bottom of the body portion, the shank including a shank axial length that is longer than the body axial length; and an outer surface of a first portion of the shank adjacent a distal end of the shank being tapered radially outwardly as it extends toward the distal end; and a base block that includes a base mounting portion including a base surface; a device receiving portion integrally extending from the base mounting portion opposite the base surface; and a base block bore extending through the device receiving portion, the base block bore adapted to receive the shank of the bit holder.

These and other aspects of the present disclosure are disclosed in the following detailed description of the embodiments, the appended claims and the accompanying figures.

BRIEF DESCRIPTION OF THE DRAWINGS

The various features, advantages, and other uses of the apparatus will become more apparent by referring to the following detailed description and drawings, wherein like reference numerals refer to like parts throughout the several views. It is emphasized that, according to common practice, the various features of the drawings are not to-scale. On the contrary, the dimensions of the various features are arbitrarily expanded or reduced for clarity.

DETAILED DESCRIPTION

Figure 1:
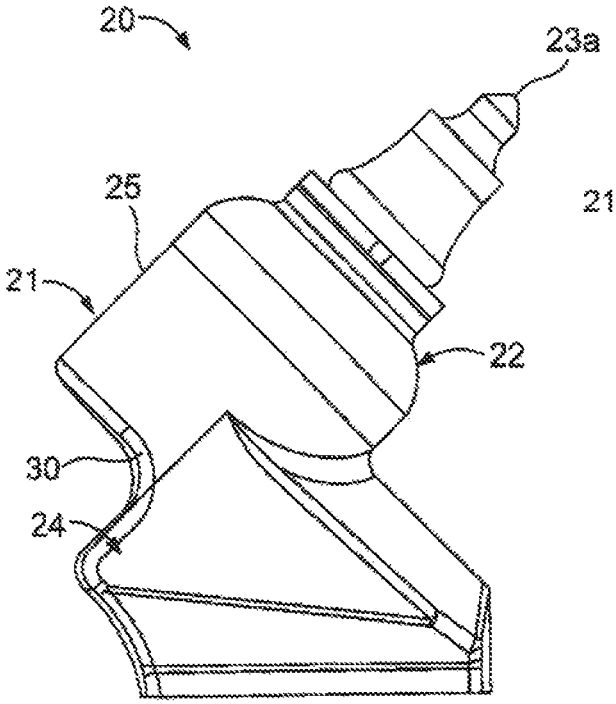
FIG. 1 is a side elevational view of a first embodiment of a bit assembly constructed in accordance with implementations of this disclosure.
Figure 2:
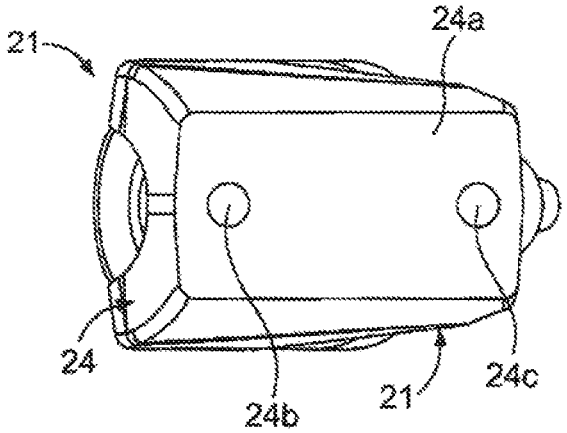
FIG. 2 is a bottom plan view of the bit assembly shown in FIG. 1 constructed in accordance with implementations of this disclosure.

Referring to FIGS. 1-4, 8 and 16, a first embodiment of a complete bit assembly 20 constructed in accordance with the present disclosure, includes a first embodiment of a bit holder block 21, a bit holder 22, and a bit 23. A plurality of these assemblies, as mentioned previously, sometimes up to 900, for micro-milling operations, are mounted in V-shape or spiral fashion around the outside of a hollow cylindrical drum (not shown), typically 46-54 inches in diameter. Also, a bottom 24*a* of a base 24 of the bit holder block 21 of the bit assembly 20 may be mounted on an endless chain or chain and plate system or drum (not shown) for trenching or mining operations.

The First Embodiment Bit Assembly

Figure 7:
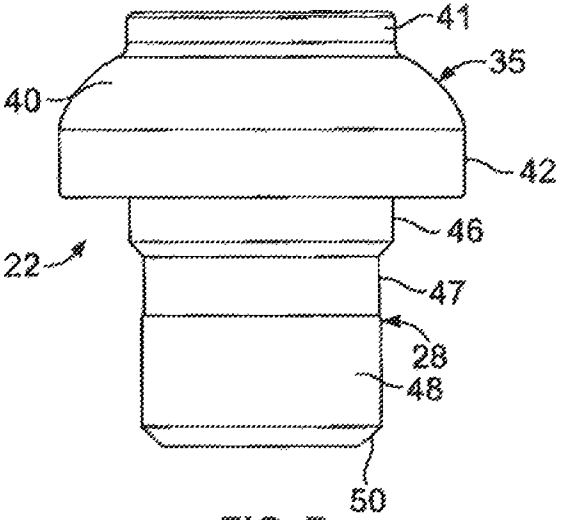
FIG. 7 is a side elevational view of the bit holder shown in FIGS. 5 and 6 constructed in accordance with implementations of this disclosure.

Each bit assembly 20 includes the first embodiment of the bit holder block 21 having a base 24 and a bit holder or bit/holder mounting portion 25. In this embodiment, the bit holder mounting portion 25 is generally cylindrical and extends from the base 24 portion as mentioned previously. The bit block 21, constructed in accordance with the present disclosure, includes the axially shortened annular bit holder mounting portion 25 which receives the bit holder 22 or bit/holder (26*a*, 26 FIGS. 8 and 15) in a bit block bore 27 positioned centrally therein. The shortened axial length of the generally annular bit holder receiving portion 25 approximates 1.5 inches in length with a nominal diameter of 1.5 inches (FIG. 7). The ratio of bit holder shank diameter D, bit holder mounting position, to its length L is generally a one to one ratio.

Figure 4:
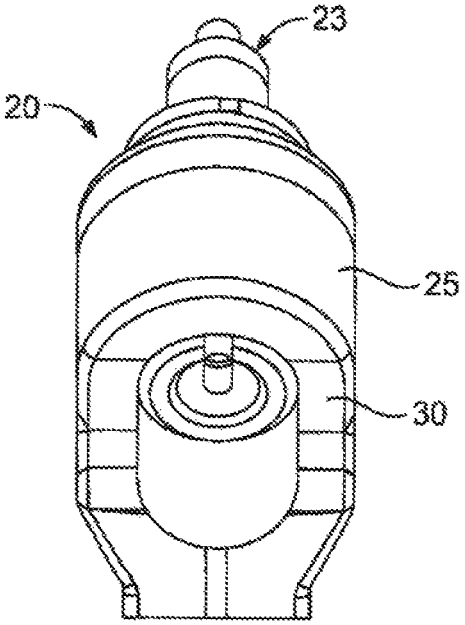
FIG. 4 is a rear elevational view of the bit assembly shown in FIG. 1 constructed in accordance with implementations of this disclosure.
Figure 11:
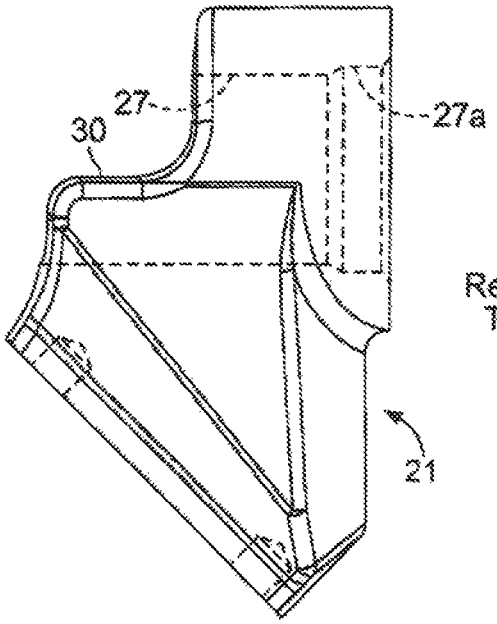
FIG. 11 is a detailed side elevational view of the increased rear access bit holder shown in FIG. 1 constructed in accordance with implementations of this disclosure.

As shown most clearly in FIG. 11, the shortened shank can use an improved structure for either selectably releasing or securing the bit holder to the bit holder block 21. The bit holder block bore 27 includes an enlarged (0.030 inch per side) upper shoulder portion 27*a* approximately ¼-⅜ inch in axial depth. The remainder of the bit block bore 27 may be straight cylindrical or a non-locking taper, preferably one degree per side. The shortened portion of the bit holder block/bit holder receiving portion is shown most clearly in FIGS. 1 and 16 and is about 1½ inch in length. The shortened bit holder block bore 27 accepts a shortened bit holder shank 28 of the bit holder 22 such as shown in FIGS. 5, 6, 7, 12, 13 and 14. The shortened shank mounting provides a recess 30 that adds access to the base 29 (FIG. 9) of the bit holder shank 28, and the base of the bit 23, also shown in FIGS. 4 and 16, provides over an inch of added access space 30 to the back of the hollow bit holder receiving portion 25, thus more adequately allowing a driving rod or other removal tool (not shown) to drive the bit holder 22 outwardly of the bit holder block bore 27 from the bottom thereof.

Figure 5:
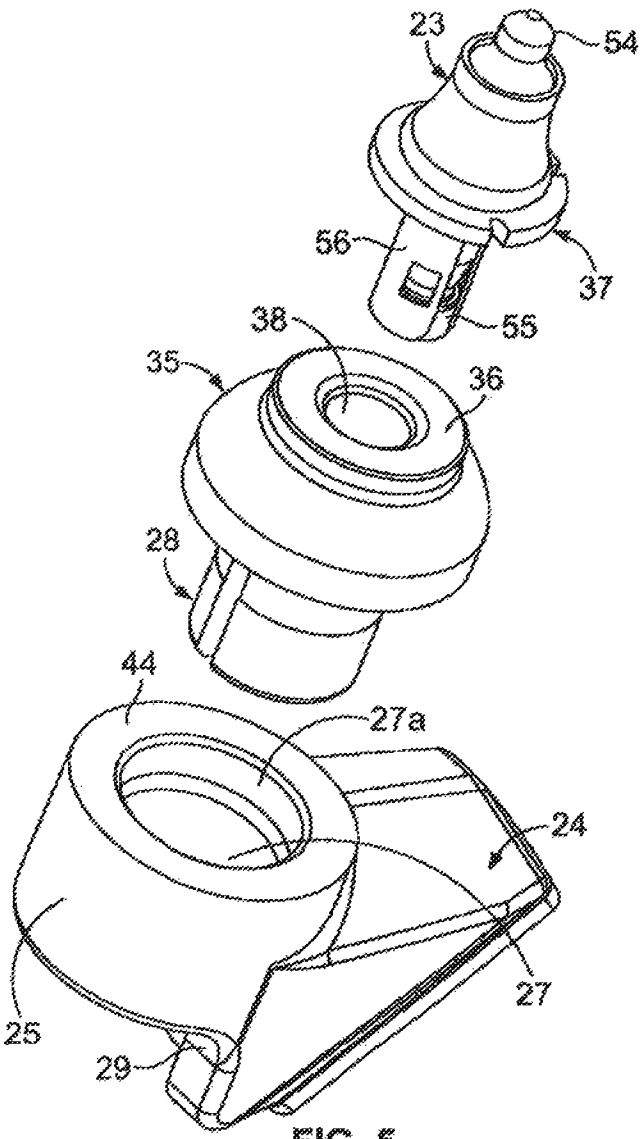
FIG. 5 is an exploded perspective view of the bit assembly shown in FIG. 1 constructed in accordance with implementations of this disclosure.
Figure 14:
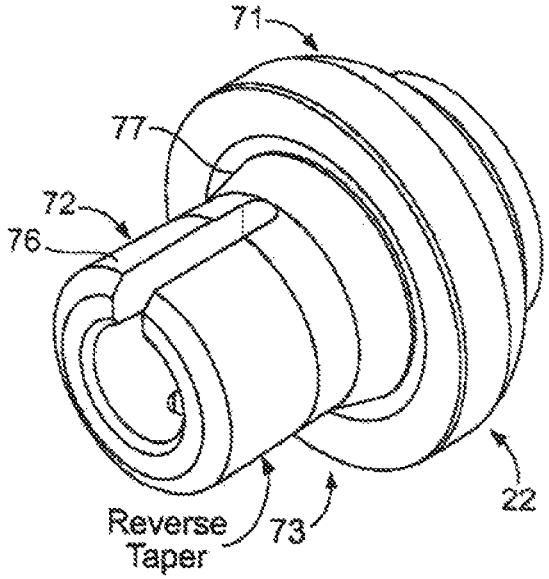
FIG. 14 is a rear ¾ perspective view of a first modification of the third embodiment of the bit holder having a reverse taper similar to FIG. 13, but including a tapered annular upper shank segment above the inner end of the shank slot and yet below the tire portion of the bit holder body constructed in accordance with implementations of this disclosure.

The bit holder block 21 mounting base 24 is similar to that previously known, in having a generally rectangular bottom 24*a*, which may be slightly curved to fit on the outside of a rotating drum (not shown), with a pair of mounting holes 24*b*, 24*c* therein. The base 24 may slightly widen from its bottom wall 24*a* and eventually forms a pair of triangular sides 31, 32 together with a peaked front portion sloping downwardly and outwardly from an upward ridge 39 thereof to deflect material which is loosened by the tip and body of the bit 23 mounted on the bit holder 22. At the top of the bit holder block, shown most clearly in FIG. 5, is the bit holder base block mounting portion 25 which is generally annular in construction having the bore 27 centrally therethrough, which includes the upper expanded portion 27*a* that may be cylindrical in shape or may have a non-locking taper to fit the bit holder 22 therein such as shown in FIG. 14.

As mentioned previously, the remainder or bottom portion of the bit holder block bore 27 may be cylindrical or have a non-locking taper, presently preferably a one degree per side, conforming to the distal taper of the bit holder shank (or not conforming thereto as will be discussed in more detail below).

Figure 16:
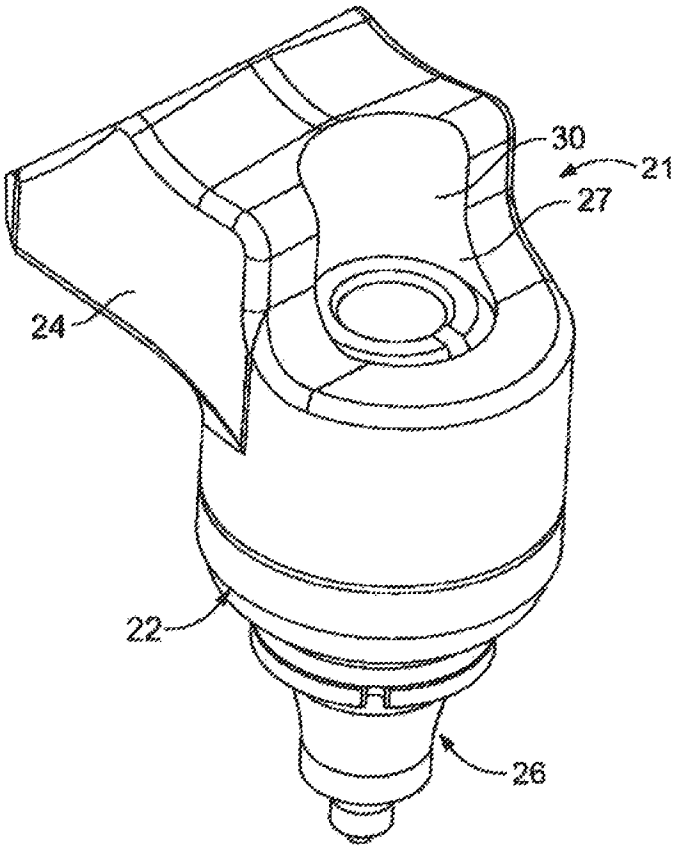
FIG. 16 is a bottom ¾ perspective view of the first embodiment bit assembly shown in FIG. 1 disclosing the added access space adjacent the bottom of the first embodiment of the bit holder block constructed in accordance with implementations of this disclosure.

FIG. 16 shows the first embodiment of the bit assembly 20 as it appears when mounted on a rotating drum (not shown) in an upside down position in which a drive punch (not shown) may be utilized to drive out the bit holder 22 from the bit holder block bore, or in which a smaller drive pin may be utilized to drive out a bit from the bit mounting bore of the bit holder.

Figure 3:
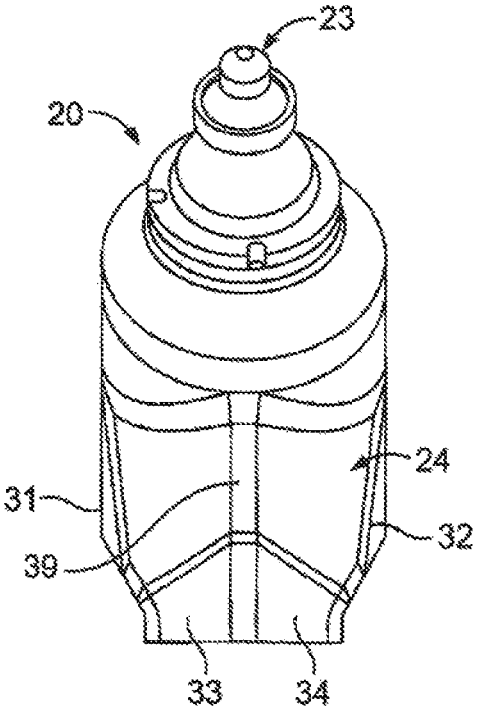
FIG. 3 is a front elevational view of the bit assembly shown in FIG. 1 constructed in accordance with implementations of this disclosure.

The base 24 of the bit holder block 21 and the recess 30 in which the bit holder block bore 27 extends as shown in FIG. 16 is smoothly shaped to conveniently allow the macadam, cement or concrete particles, or terra firma (not shown) that may be logged thereon to be more easily removed therefrom when obtaining access to the base 24 of the bit holder block 21. As shown in FIG. 3, the very front of the bit holder block 21 may be cut off to form a pair of opposed substantially vertical wall portions 33, 34 which provide added space for mounting adjacent bit blocks on a drum, or an endless chain. Thus, a plurality of bit holder blocks 21 may be mounted in closer proximity to one another, especially for use in micro milling operations wherein adjacent bit assembly bit tips 23*a* are mounted at a 0.200 inch axial spacing, rather than the more conventional 0.625 inch axial spacing found in regular bit assemblies mounted on drums for road milling purposes. The width and length of the bit holder block is important in achieving 0.200 inch spacing.

Details of the Bit Holder

A First Illustrated Embodiment of A Bit Holder

Figure 6:
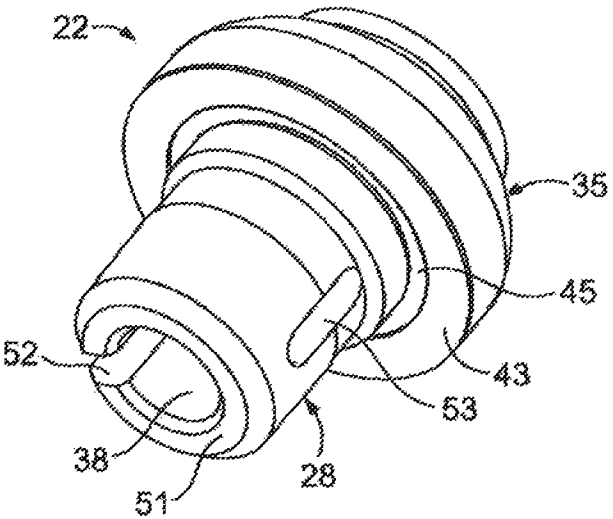
FIG. 6 is a rear ¾ perspective view of the bit holder shown in FIG. 5 constructed in accordance with implementations of this disclosure.

In addition to the figures previously mentioned, FIGS. 5, 6 and 7 disclose detailed views of a bit holder 22 of the first embodiment shown in assembly form in FIGS. 1-4 and 16. The bit holder 22 includes a top body portion 35 and a bottom shank portion 28 (both substantially annular). The top or body portion 35 of the bit holder 22 includes a flat upper annular face 36 with a generally cylindrical outline that is typically identical to or very similar to the major diameter of the bit 23, or bit washer 37, which may be mounted on that upper face 36 and in a central bit bore 38 in the bit holder 22 extending axially through the bit holder body portion 35 and shank 28.

A central portion 40 of the bit holder body portion 35 extends outwardly from a generally cylindrical upper bit mounting portion 41 in this embodiment in a convex shape, although it may be convex, conical or concave, but is generally shaped to deflect material outwardly thereof as it is separated by the bit tip 23*a* and moves axially and outwardly along the bit 23, bit holder 22 and bit holder block 21 bodies.

As the central portion 40 of the first embodiment of the bit holder 22 widens out, it terminates at the juncture between the central portion and the base 42, or what is termed "the tire portion" of the bit holder 22, which is a cylindrical segment approximately ½ inch in axial height and nominally 2⅝ inch in diameter. The tire portion 42 terminates in an annular radially extending flange 43 forming the bottom portion of the body of the bit holder. This bottom portion is adapted to fit contiguously with a top annular surface 44 of the bit holder receiving portion 27 of the bit holder block 21 previously described. The contiguous fit allows for fewer critical surfaces between the two parts than if the tire portion 42 is spatially related to the top surface 44 of the bit holder block 21 as the shank 28 is fully mounted in the bit holder block bore 27. At the interior of the radially extending flange 43 is a U-shaped undercut 45 which meets at its inner end with the shank 28 of the bit holder 22. This U-shaped groove 45 provides a stress relieving portion between the body portion 35 and shank 28 of the bit holder 22, avoiding sharp edges.

Axially extending from the U-shaped groove 45 is the shank 28 of the bit holder. The top portion of the shank 28 immediately adjacent the body is an enlarged portion 46, approximately ¼-⅜ inch in axial length that is fitted in an interference fit with the enlarged top bore portion 27*a* of the bit holder block bore 27 previously discussed. In this first embodiment, this enlarged portion 46 is generally cylindrical in shape. On nominal 1¼-1¾ inch diameter shanks, the interference fit with the bit holder block bore approximates 0.001 to 0.003 inches. Immediately adjacent axially outwardly of the enlarged top segment 46 of the shank 28 is a narrowed portion 47 about ⅛-⅝ inch in length, which may be tapered or cylindrical in axial dimension. A distal portion 48 of the shank 28, approximately ½ to 1⅝ inch in length is, in this first embodiment, a non-locking taper extending toward the chamfer 50 along with its radially extending bottom flange 51, defining the bottom of the bit holder shank 28.

In this first illustrated embodiment of bit holder 22, the central portion 47 and the distal portion 48 of the shank 28 may include a pair of slots, one slot 52 extending to the outer distal end of the shank and one internal slot 53, both axially oriented, a preferred 180 degrees apart. These slots allow the distal portion 48 of the shank, a nominal 1½ inch in diameter, which may be cylindrical or non-lockingly tapered with an interference dimension approximately 0.005-0.030 inch larger than the adjacent bottom portion of the bit holder block bore 27 (as discussed in more detail below), thus allowing the shank 28 to radially collapse as it comes into interference with the bit holder block bore 27 a greater amount than would be found in published solid body interference tables. The interference may be termed a differential interference with the bit holder block bore as it increases as one moves from the top of distal portion 48 to the bottom thereof. This interference is increased until it creates a radial force of between 5 thousand and 30 thousand pounds radial force which maintains the bit holder 22 in the bit holder block 21 during the rugged use to which the bit assembly 20 is subjected.

Experiment and observation has shown that in previous embodiments of the present disclosure utilizing identical bit holder shank/bit holder block bore tapers most of the interference fit occurs in the upper portion of the slotted tapered part of the shank. The longer the slotted portion in the shank, the lesser the bending force at the distal end of the shank takes place, yielding less holding force toward the distal end of the shank.

By reducing the angle of the tapered distal portion 48 near the end of the shank of the bit holder 22 more force is radially applied near the distal end of the shank to provide greater differential interference between the shank 28 and bit holder block bore 27. Sufficient holding force may be obtained with a shorter shank than heretofore known.

As long as the cylindrical or non-locking tapered portion 48 of the bit holder shank 28 has an increased convergence with the bit holder block bore 27 toward its bottom flange 51, many combinations such as outward tapered shank/cylindrical block bore, cylindrical shank/inward tapered block bore, inward tapered bore/less inward tapered shank, inward tapered bore/outward tapered shank, etc., can be engineered to provide the necessary holding force between the bit holder and bit block bore. Non-locking tapers generally extend from 0.01 degrees to 3.5 degrees per side or up to a 7 degree total on a diameter.

Referring to FIGS. 1, 3, 4 and 5, the bit assembly 20 of this first embodiment concludes with a bit 23 having a body portion with a generally conically brazed carbide distal tip 54 at the upper end thereof, an annular flange at the bottom of the body portion (not shown) and a generally cylindrical shank 55 which, in this first embodiment, includes inwardly extending space for mounting a spring steel C-shaped retainer 56 thereon. In use, this type of bit is allowed to rotate in the bit holder bore 38. The bit holder 22 does not normally rotate in the bit holder block bore 27.

A Second Illustrated Embodiment of a Bit Holder

Figure 9:
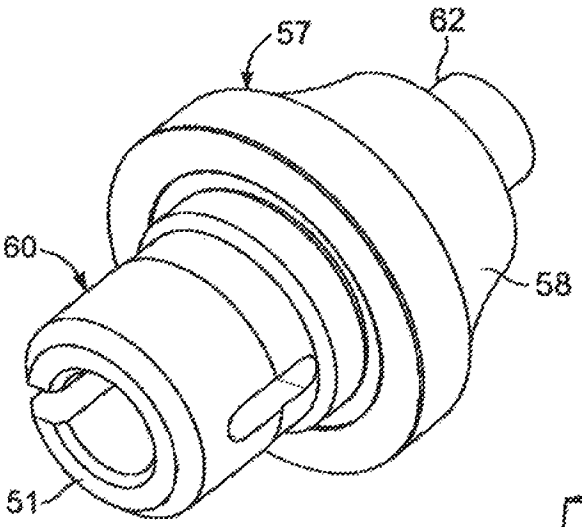
FIG. 9 is a rear ¾ perspective view of the base of the combination bit/holder shown in FIG. 8 constructed in accordance with implementations of this disclosure.
Figure 10:
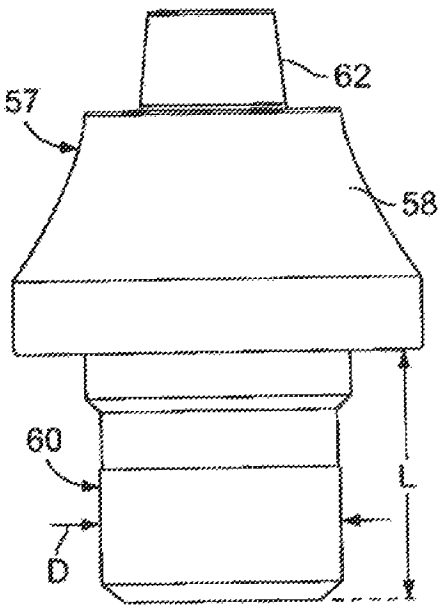
FIG. 10 is a side elevational view of the base for the combination bit/holder shown in FIG. 8 constructed in accordance with implementations of this disclosure.
Figure 8:
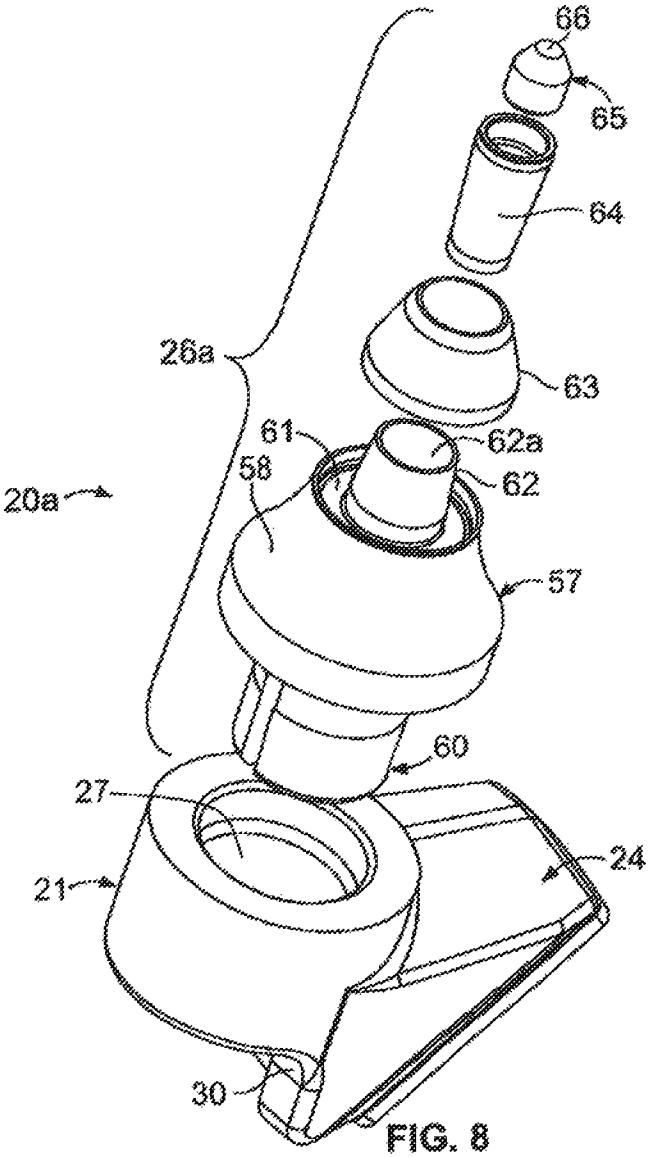
FIG. 8 is an exploded view of a second embodiment of the bit assembly of the present disclosure including a diamond tipped combination bit/holder constructed in accordance with implementations of this disclosure.

Referring to FIGS. 8, 9 and 10, a second embodiment of a bit assembly 20*a* of the present disclosure is shown and described. This second embodiment includes a bit holder block base 24 identical to that shown in the first embodiment. However, it also includes a unitary bit/bit holder 26*a* that has a base 57 with a body portion 58 from the lower part of which a shank 60 axially extends. This body portion 58 and shank 60 are substantially identical to the body portion 35 and shank 28 of the first embodiment of the present disclosure. However, the uppermost face of the central portion of the body 58 includes an annular recess 61 from which a tapered annular distal portion 62 axially extends. The combination of the outer surface of the distal tapered portion 62 and the annular recess 61 provides a base surface for mounting an annular tungsten carbide ring 63 which is a hollow frustoconical shape tapering from its bottom to the top thereof and snugly fitting over the distal annular portion 62 of the body 58. The upper distal annular portion 62 of the body 58 includes a central recess 62*a* into which a reverse taper member 64 receiving recess is formed. This reverse taper member 64 slidingly fits and is retained in the distal recess 62*a* upper portion 62*a* of the body or base 58. A diamond coated generally conical distal ended bit tip 66 is mounted in the recess formed in the top of the reverse taper member 64. All these members are brazed in their respective recesses to form a generally unitary bit/holder 26*a* that fits in the bit holder block bore 27 similarly to the first embodiment of bit assembly 20 of the present disclosure.

The diamond tip 66 at the top of the bit/holder 26*a* has an in-use life substantially greater than a tungsten carbide tip. As such, this unitary member does not have to rotate due to the long useful life that the diamond coated tip 66 provides. The shortened shank 60 of the base 58 of the bit/holder 26*a* fits in the bit holder block bore 27 similarly to the shank of the holder in the first embodiment and is provided with ease of extraction therefrom similarly to the first embodiment.

The structure of the top portion of the bit/holder is generally found in Applicant's U.S. Pat. No. 6,739,327 in which this top portion forms the top portion of a bit which is removable from its respective bit holder.

A Third Illustrated Embodiment of a Bit Holder

Figure 12:
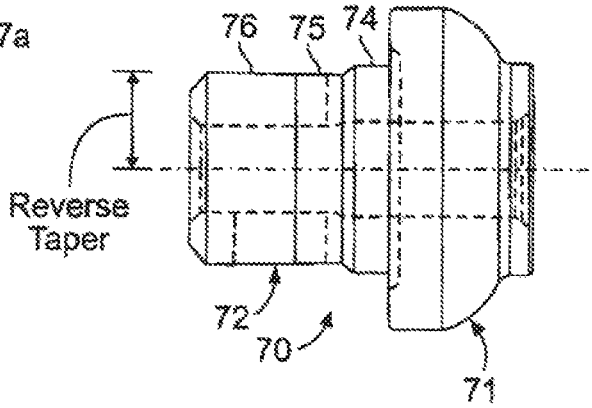
FIG. 12 is a side elevational view of a third embodiment of the bit holder shown in FIG. 7 wherein the distal end of the shank includes a reverse taper constructed in accordance with implementations of this disclosure.
Figure 13:
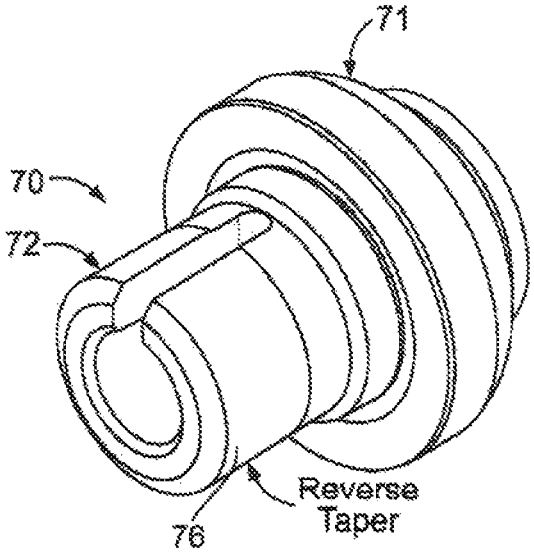
FIG. 13 is a rear ¾ perspective view of the third embodiment of the reverse taper bit holder shown in FIG. 12 constructed in accordance with implementations of this disclosure.

Referring to FIGS. 12, 13 and 14, a third embodiment of a bit holder 70 is shown. This third embodiment of bit holder 70 also includes an upper body portion 71 and a lower shank 72 portion. A first modification of a bit holder 73 of the third embodiment is shown in FIG. 14, to be discussed in more detail below. In each, the upper body portion 71 of the bit holder is substantially identical to the upper body portion of the first embodiment bit holder 22, shown in FIGS. 1, 3, 5, 6 and 7. Also, an upper portion 74 and a center portion 75 of the shank 72 of this embodiment is identical to that shown in the first embodiment of bit holder 22, specifically FIGS. 5, 6 and 7 thereof. However, the difference between the first embodiment of bit holder 22 and this third embodiment of bit holder 70 is found in a specific reverse non-locking taper of a distal portion 76 of the shank 72 (as shown in FIGS. 12-14). This non-locking size reverse taper fits in either cylindrical, or the preferred one degree per side regular taper of the bit holder block bore 27 shown most clearly in FIG. 11. The reverse taper provides a substantial differential interference fit between the portion of the distal taper 76 and the bit holder block bore 27 over only a portion of the length of the shank 72 and the bore 27.

Applicant has found that in prior art quick-change bit holder/bit holder block combinations having identical cylindrical or tapered distal and bottom portions, respectively, that there is less radial force applied in the bit holder shank as one approaches the distal end of the shank, and a greater radial force as one approaches the upper termination of the open ended slot. Therefore, a slight difference or reversal of the distal portion of the bit holder shank diameter will tend to equalize the radial forces between the bottom of the bit holder block bore and along the entire length of the distal portion of the shank. Applicant terms this a differential interference to distinguish it from known prior art.

This slight difference (differential interference) in tapers can exist along a spectrum of shapes. In the disclosure, the bottom portion of the shank having a constant taper is about ½ to 1⅝ inch in axial length. In prior art bit holder/bit holder block bore combinations, each part had equal non-locking tapers, preferably 1 degree or less per side. In this third embodiment, the bit holder shank 72 may preferably have a 1 degree outward taper to a bit holder block bore 27 having a 1 degree inward taper or cylindrical configuration, respectively. Similarly, the bit holder shank 72 may be cylindrical with a non-locking taper on the bit holder block bore 27. The relative convergence of the tapered/cylindrical surfaces (differential interference) may differ as discussed in the first embodiment.

Of course, if one wants more force applied toward the bottom of the distal portion 76 of the shank 72, then a larger degree of non-locking taper difference is desired. The degree of difference in the tapers is limited only by the limits of non-locking tapers and by the diameter of the shank end and the diameter of the top opening of the bit holder block bore. One needs to be able to center the bit holder shank in the bit holder block bore 27 to drive it into place.

Non-locking tapers are about 3½ degrees per side or 7 degrees total. The present illustrated embodiments provide the shortest shank distal portions. As one increases the differing tapers toward the limits of non-locking tapers, the length of the distal or bottom portion of the shank and bit holder block bore must increase to allow the required total holding force to be obtained.

This limited difference (differential interference) in substantial annular contact surface between the distal end of the shank and the bottom of the bit holder block bore provides for greater ease of entry and removal of the bit holder from the bit holder block by only having to move the bit holder a short distance in the bit holder block to obtain release. The size of the non-locking, presently preferred ½ degree per side or greater reverse non-locking taper in the nominal 1½ inch diameter of the shank 72 is sized to fit the bottom portion of the bit holder block bore 27 with an interference that approximately exerts between 5 to 30 thousand pounds of radial force, but over a shorter axial contact surface distance. One or two slots may be used. A single slot exerts more radial force than two slots. The combination of the slotted reverse taper shank 72 and the generally cylindrical upper expanded cylindrical shank portion 74 having a standard 0.001-0.003 interference with the upper expanded portion 27*a* of the bit holder block bore 27 provides for a substantial mounting of this embodiment of the bit holder 70 in the bit holder block bore 27 during use.

FIG. 14 shows the first modification of bit holder 73 of the third embodiment wherein an upper portion 77 of the bit holder shank 72 is tapered rather than cylindrical in shape having a locking or non-locking taper that would fit in a complementarily shaped taper in the upper portion of the bit holder block bore (not shown).

A Fourth Illustrated Embodiment of a Bit/Holder

Figure 15:
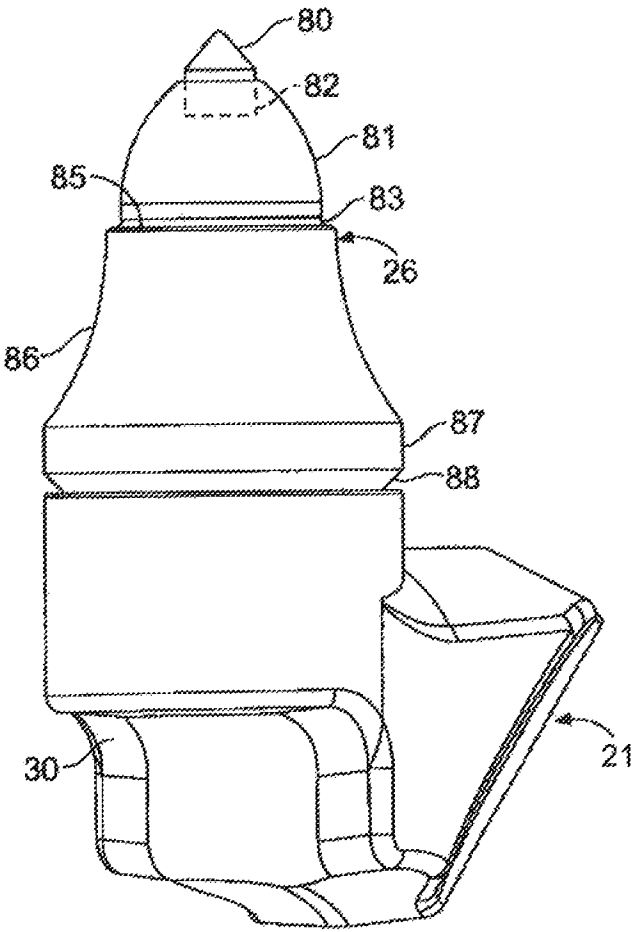
FIG. 15 is a side perspective view of a fourth embodiment combination bit/holder including a diamond tip thereon integrally formed with a holder body as mounted in a first embodiment of a bit holder block constructed in accordance with implementations of this disclosure.

FIG. 15 discloses a fourth embodiment of a bit/holder 26 of the present disclosure providing a combination bit/holder that fits in the improved bit holder block 21 shown in the previous embodiments. The bit/holder 26 includes a generally conical distal ended tip 80 which is either diamond coated or contains a solid diamond tip such that the bit/holder is a unitary structure which fits into the bit holder block bore 27, similarly to the previous embodiments described herein. An upper portion or bolster 81 of the bit/holder aft of the tip includes a tungsten carbide, generally convex shaped member having a recess 82 at the top thereof into which the diamond tip 80 is positioned and brazed. Likewise, an enlarged base 83 of the bolster 81 is brazed onto the top of a body portion 86 of the bit/holder 26.

This body portion 86 includes a recessed counterbore or slightly concave top surface 85, onto which the bolster is brazed, and is an outwardly and axially extending body portion 86 which, in this embodiment, may be concave or convex in surface outline. The lower portion 86 of this central concave portion ends in a generally cylindrical tire or base portion 87 which is similar to the base portions shown in the previous embodiments except that the distal end thereof includes a 45 degree inwardly extending portion 88 that ends in a flat annular face. This 45 degree taper portion 88 provides access for a generally forked tool (not shown) which may be used, as an alternative to the previously mentioned drift pin, to extract the bit/holder from its bit holder block bore. Likewise, in this embodiment, the fourth embodiment bit/holder 26 may be turned upside down similarly to the first embodiment shown in FIG. 16. Thus, with the improvement of the recessed and shortened rear of the bit holder block allowing increased access to the bit/holder shank (not shown), an extraction punch may more easily be used that will force the bit/holder shank axially outwardly of the bit holder block bore 27. Again, in this fourth embodiment, the diamond tip provides a substantially improved bit/holder life such that the bit/holder 26 does not have to rotate, but may be firmly mounted in the bit holder block bore 27 with 5 to 30 thousand pounds of radial force similarly to the prior shown embodiments.

A Fifth Illustrated Embodiment of a Bit Holder

Figure 17:
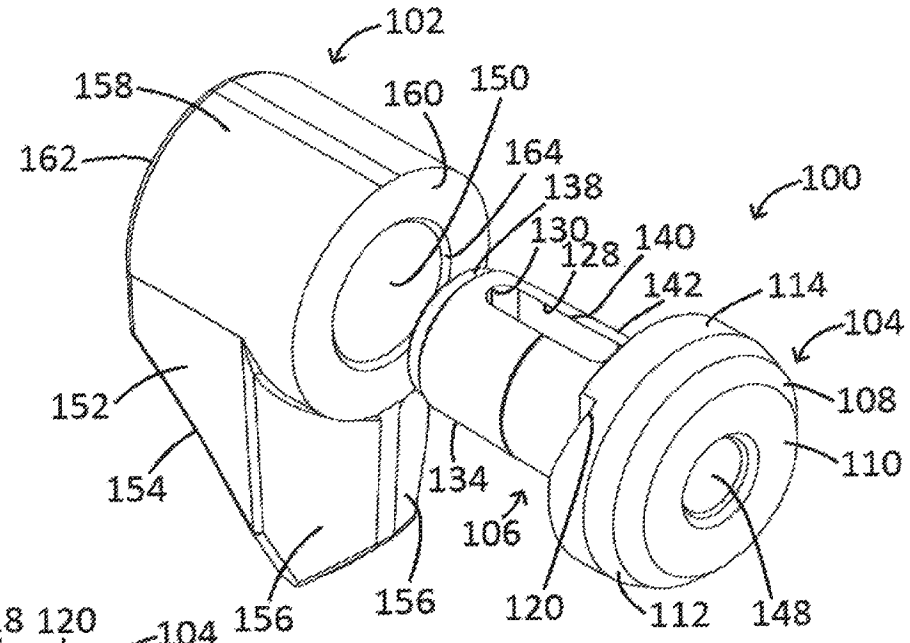
FIG. 17 is an exploded perspective view of a fifth embodiment of a bit holder and a second embodiment of a bit holder block constructed in accordance with implementations of this disclosure.
Figure 18:
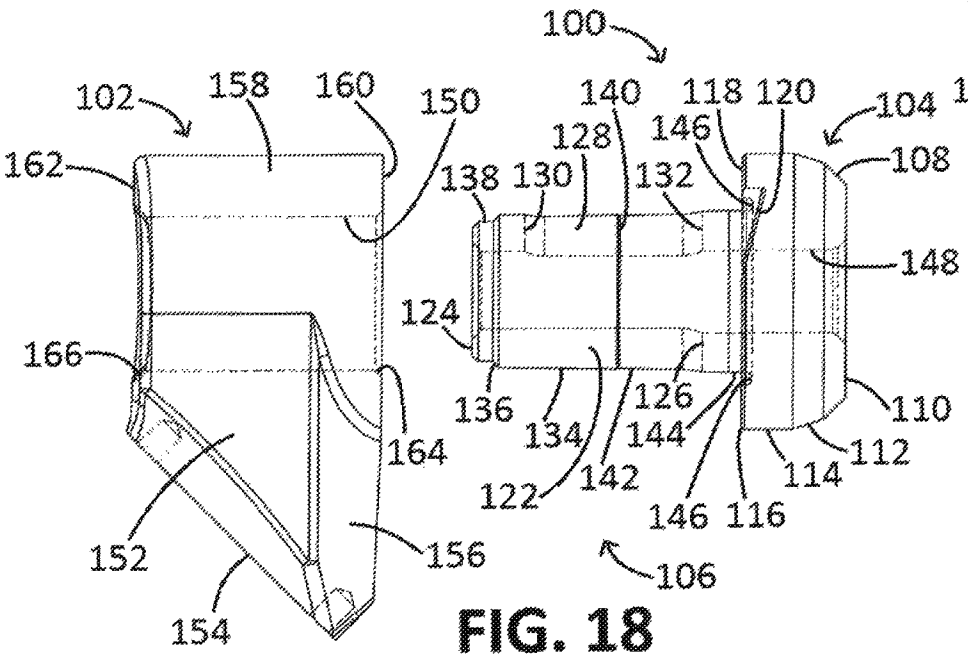
FIG. 18 is an exploded side elevation view of the fifth embodiment of the bit holder and the second embodiment of the bit holder block, showing invisible internal elements in dotted lines, constructed in accordance with implementations of this disclosure.
Figure 19:
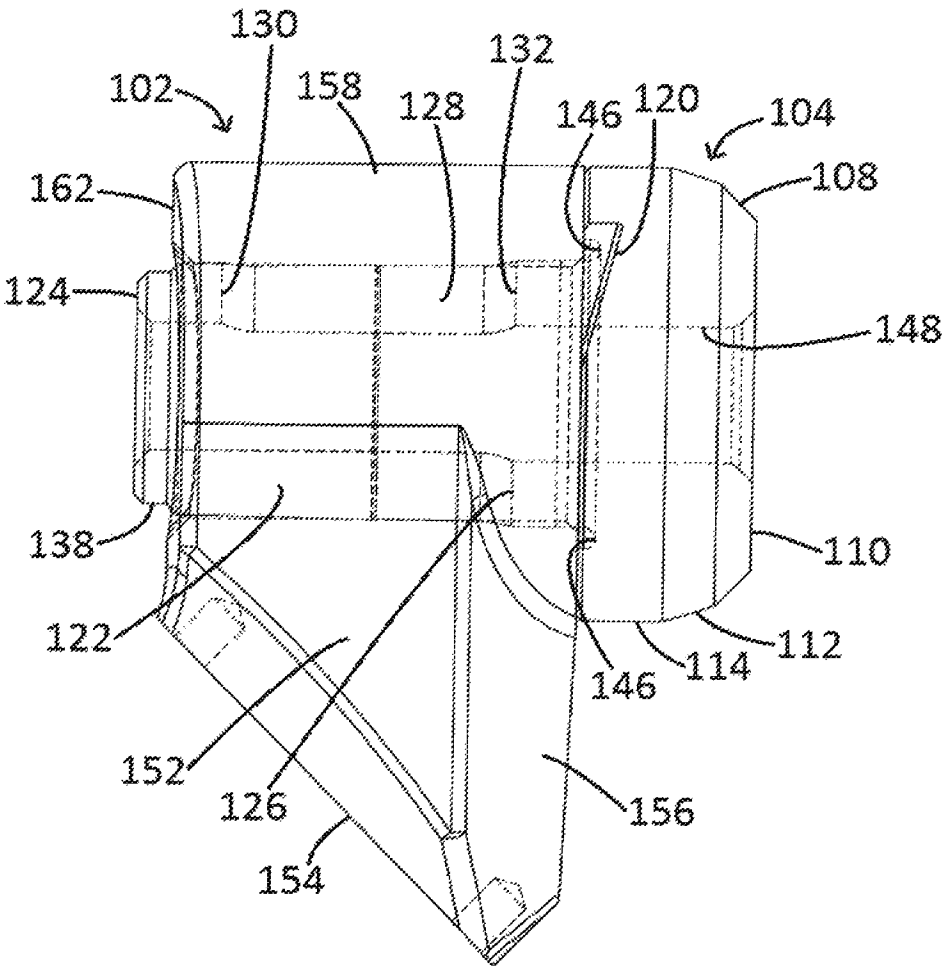
FIG. 19 is a side elevation view of the fifth embodiment of the bit holder assembled in the second embodiment of the bit holder block, showing invisible internal elements in dotted lines, constructed in accordance with implementations of this disclosure.

Referring to FIGS. 17-19, a fifth embodiment of a bit holder 100 and a second embodiment of a bit holder block or base block 102 are shown. The bit holder 100, in this illustrated embodiment, is an approximately 2¾ inch generally standard length shank bit holder that comprises a nose portion or bit holder body 104 and a generally cylindrical hollow shank 106 axially depending from a bottom of the nose portion 104. This design can also be implemented successfully with various length shanks. The nose portion 104, in this exemplary implementation of the fifth illustrated embodiment, is generally annular in shape and comprises a frustoconical first portion 108 axially extending from a top surface 110, such as a flat annular top surface, a frustoconical second portion 112 axially extending from the first portion 108, and a generally cylindrical tire portion 114 axially extending from the second portion 112. A chamfer 116 extends from a bottom of the tire portion 114 to a back flange 118, which may be generally annular. The back flange 118 includes a pair of horizontal slots 120-120 (one shown in FIGS. 17-19) generally perpendicular to the longitudinal axis of the bit holder 100, one on either side of the back flange 118. The horizontal slots 120-120 are adapted to receive a pair of bifurcated fork tines that may be inserted between the base of the nose portion 104 of the bit holder 100 and the second embodiment of the base block 102, or a third embodiment of a base block 202 (FIGS. 23-25), into which the shank 106 of the bit holder 100 is inserted and retained by outward radial force while use. Other base block configurations can be used without deviating from the concept of this design.

The shank 106 includes an elongate first slot 122 extending from a distal end 124, such as a generally annular distal end, of the shank 106 axially upward or forward to an upper termination 126 near the upper or forward end of the shank 106. In this exemplary implementation, the shank 106 also includes an internally oriented second slot 128 (FIG. 17) located approximately 180 degrees around the annular shank 106 from the first slot 122. This second slot 128 is parallel to the first slot 122, in this illustrated embodiment, and is an internal slot having a rearward termination 130 (FIG. 17-19) inwardly adjacent to the distal end 124 of the shank 106 and a forward termination 132 (FIGS. 18 and 19) generally coinciding longitudinally and axially with the upper termination 126 of the first slot 122.

In this illustrated embodiment, the shank 106 also includes a lower or first outwardly tapered portion 134 running axially from a stepped shoulder 136 adjacent the distal end 124 of the shank 106. The stepped shoulder 136 increases, or steps up, as it axially extends from a distal end portion 138 of the shank 106, adjacent the distal end 124 of the shank 106, to the lower outwardly tapered portion 134. The lower outwardly tapered portion 134 runs upwardly or axially from the stepped shoulder 136 of the shank 106 and terminated generally mid slot 122 longitudinally. The shank 106 also includes an annular shoulder 140 separating the lower outwardly tapered portion 134 from an upper or second tapered portion 142 which extends from the shoulder 140 to generally adjacent to the top of the shank 106 or forward terminations 126, 132 of slots 122, 128, respectively. The annular shoulder 140 is disposed between the first outwardly tapered portion 134 and the second tapered portion 142. A diameter of the annular shoulder 140 decreases, or steps down, as it axially extends from the first outwardly tapered portion 134 to the second tapered portion 142. A generally cylindrical top portion 144 of the shank 106 extends from a position adjacent the second tapered portion 142 towards the back flange 118 that denotes the base or bottom of the nose portion 104 of the bit holder 100. The top of the shank 106 may include a rounded junction 146 (FIGS. 18 and 19) between the top portion 144 of the shank 106 and the back flange 118 of the nose portion 104 of the bit holder 100, which is provided to avoid sharp corners which may provide an area for stress cracks to begin. In other embodiments, the shank 106 may comprise different configurations, for example, the lower portion 134 and/or the upper portion 142 of the shank 106 may comprise a generally cylindrical shape, an outward taper, an inward taper, a slight draw angle, or a slight draft angle.

A central bore 148 axially extends from the top surface 110 of the bit holder 100 to the distal end 138 of the shank 106. The central bore 148 is adapted to receive the shank of a bit (not shown). The central bore 148 and the slots 122, 128 allow the generally C-shaped annular sidewall of the shank 106 to radially contract when the shank is mounted in a bore 150 (FIGS. 17 and 18) of the base block 102, or in a bore 250 (FIGS. 23 and 24) of the base block 202. (the slot 122 may be used by itself in some application.

Figure 25:
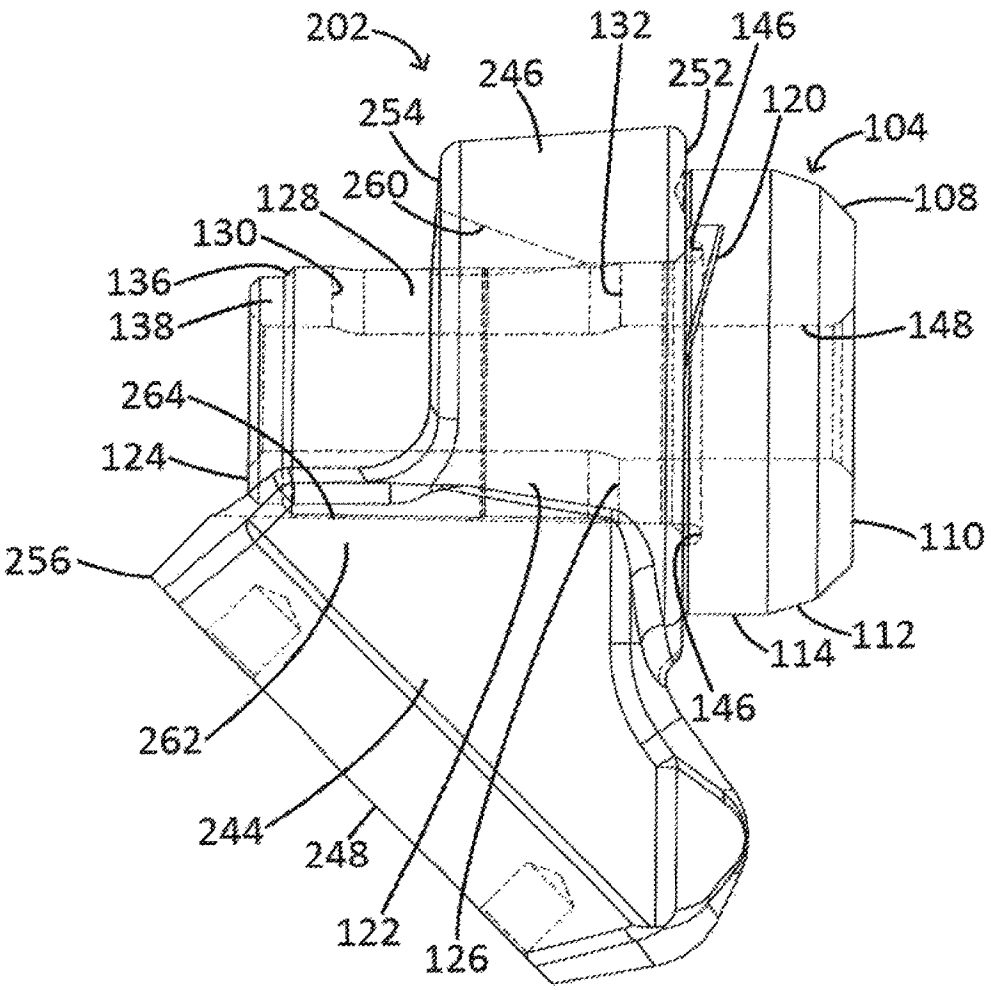
FIG. 25 is a side elevation view of the fifth embodiment of the bit holder assembled in the third embodiment of the bit holder block, showing invisible internal elements in dotted lines, constructed in accordance with implementations of this disclosure.
Figure 27:
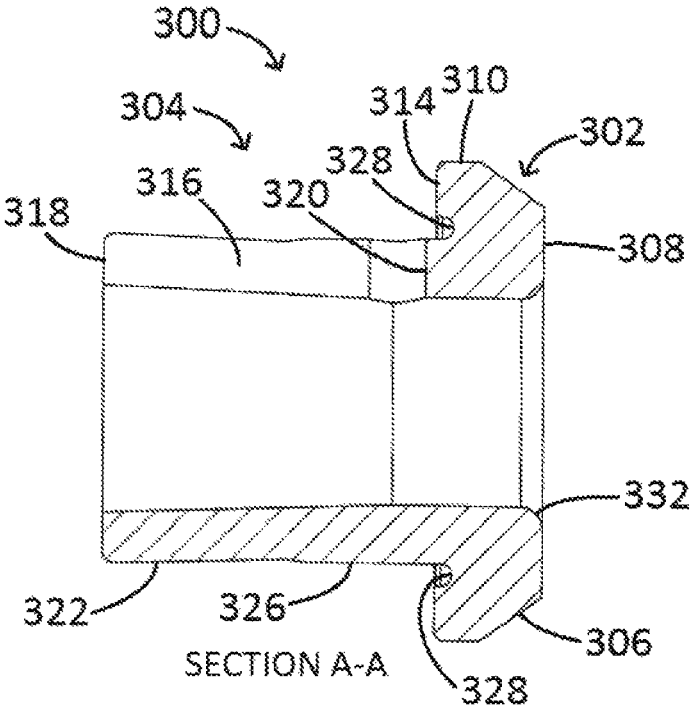
FIG. 27 is a cross-sectional view of the seventh embodiment of a bit holder, taken along line A-A of FIG. 26, in accordance with implementations of this disclosure.

The second embodiment of the base block 102 comprises a base mounting portion 152 that includes a base 154 which is mountable on the outside of a drum (not shown), or mounted to a stand or riser mounted on the drum, which is part of road milling equipment or similar drum designed machines. The front or leading portion of the base mounting portion 152 may include a pair of rearwardly angled shoulders 156-156. A generally annular and/or cylindrical bit holder receiving portion 158, adjacent the base mounting portion 152 which holds the base block 102 on the drum or stand or riser located on the drum, includes the central bore 150 that axially extends from a front face 160 of the receiving portion 158 to rear distal portion 162 of the base block 102. The bore 150 includes a countersink 164 adjacent the front face 160 and an outward taper portion 166 adjacent the rear distal portion 162. The bore 150 of the base block 102 is adapted to receive the shank 106 of the bit holder 100, as shown in FIG. 19, and the bore 148 of the of the bit holder 100 is adapted to receive the shank of the bit (not shown). Alternatively, the bore 250 of the base block 202 is adapted to receive the shank 106 of the bit holder 100, as shown in FIG. 25.

A Sixth Illustrated Embodiment of a Bit Holder

Figure 20:
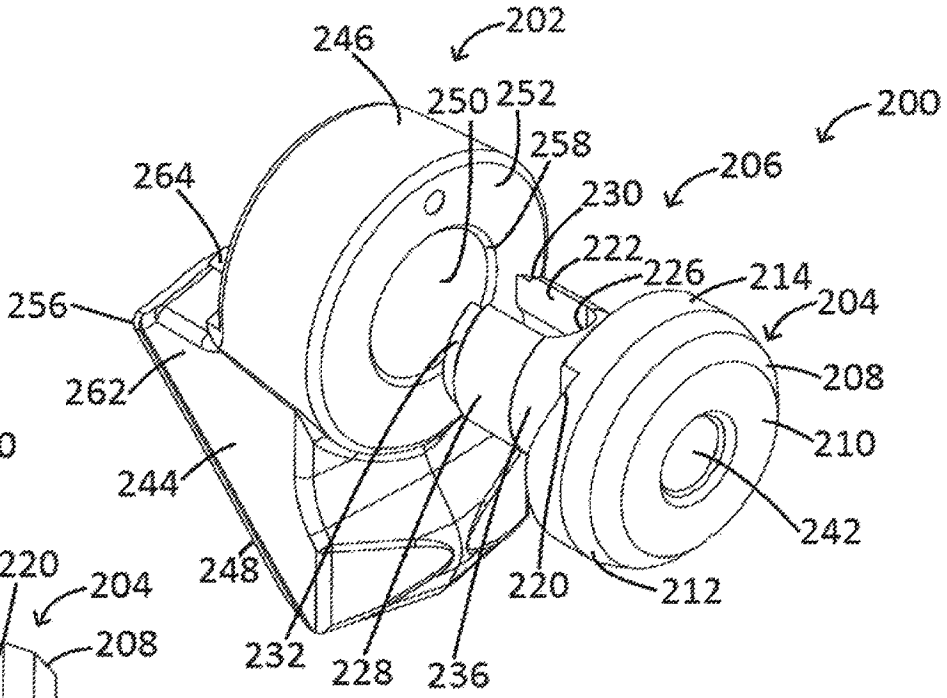
FIG. 20 is an exploded perspective view of a sixth embodiment of a bit holder and a third embodiment of a bit holder block constructed in accordance with implementations of this disclosure.
Figure 21:
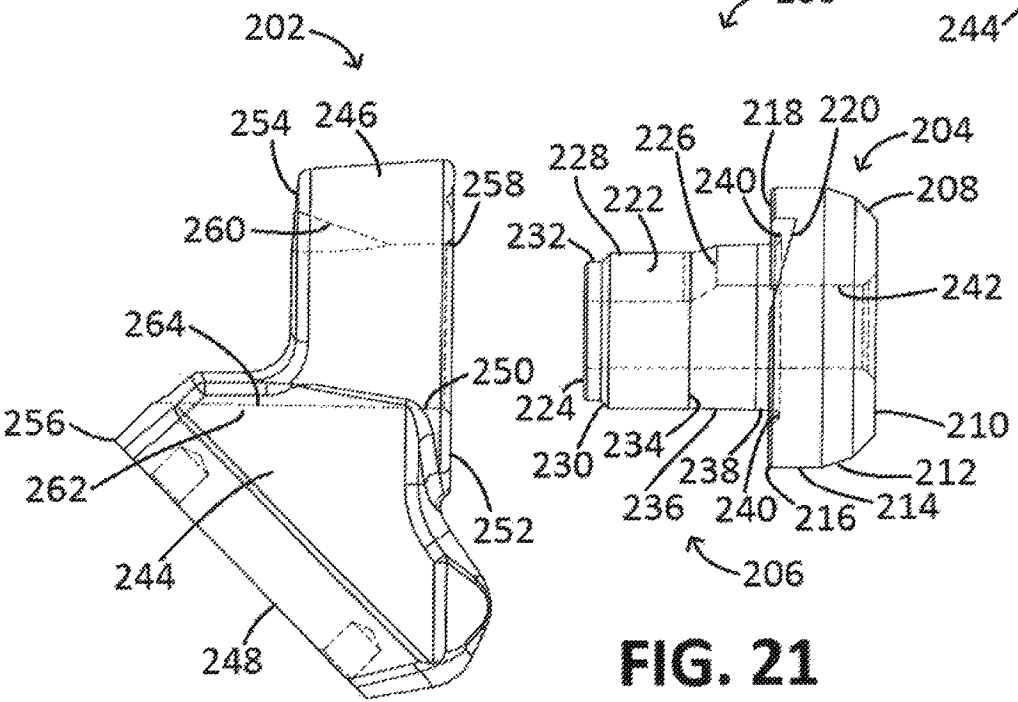
FIG. 21 is an exploded side elevation view of the sixth embodiment of the bit holder and the third embodiment of the bit holder block, showing invisible internal elements in dotted lines, constructed in accordance with implementations of this disclosure.
Figure 22:
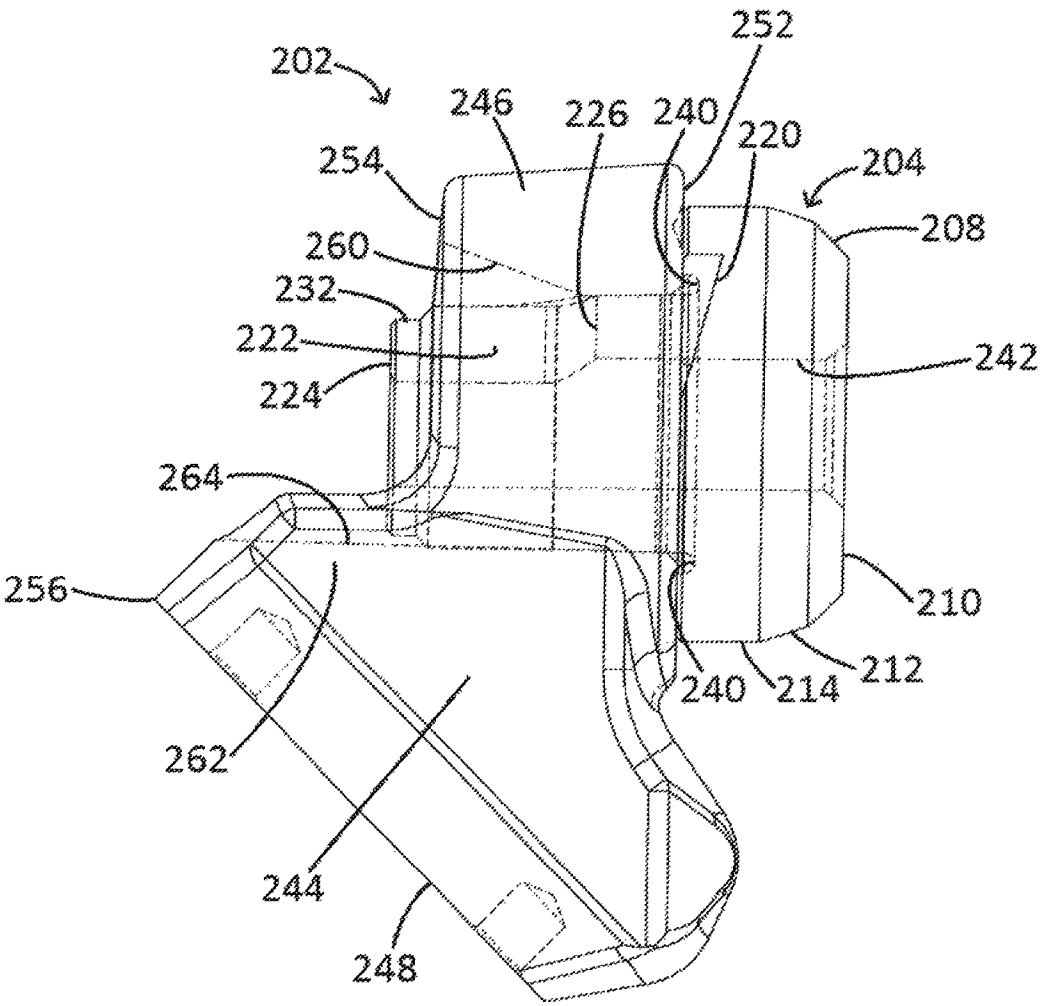
FIG. 22 is a side elevation view of the sixth embodiment of the bit holder assembled in the third embodiment of the bit holder block, showing invisible internal elements in dotted lines, constructed in accordance with implementations of this disclosure.

Referring to FIGS. 20-22, a sixth embodiment of a bit holder 200 and a third embodiment of a bit holder block or base block 202 are shown. The bit holder 200 comprises a nose portion or bit holder body 204 and a generally cylindrical hollow shank 206 axially depending from a bottom of the nose portion 204. The shank 206 of the bit holder 200 of the sixth embodiment is shorter than the approximately 2¾ inch generally standard length shank of a standard bit holder which, in this exemplary implementation, the length of the shank 206 of the bit holder 200 is approximately a nominal 1¾ inches. This design can also be implemented successfully with various length shanks. The nose portion 204, in this exemplary implementation of the sixth illustrated embodiment, is generally annular in shape and comprises a frustoconical first portion 208 axially extending from a top surface 210, such as a flat annular top surface, a frustoconical second portion 212 axially extending from the first portion 208, and a generally cylindrical tire portion 214 axially extending from the second portion 212. A chamfer 216 extends from a bottom of the tire portion 214 to a back flange 218, which may be generally annular. The back flange 218 includes a pair of horizontal slots 220-220 (one shown in FIGS. 20-22) generally perpendicular to the longitudinal axis of the bit holder 200, one on either side of the back flange 218. The horizontal slots 220-220 are adapted to receive a pair of bifurcated fork tines that may be inserted between the base of the nose portion 204 of the bit holder 200 and the third embodiment of a base block 202, into which the shank 206 of the bit holder 200 is inserted and retained by outward radial force while in use. Other base block configurations can be used without deviating from the concept of this design.

The shank 206 includes an elongate first slot 222 extending from a distal end 224, such as a generally annular distal end, of the shank 206 axially upward or forward to an upper termination 226 near the upper or forward end of the shank 206. In another embodiment, the shank 206 can also include an internally oriented second slot (not shown) located approximately 180 degrees around the annular shank 206 from the first slot 222. This second slot can be parallel to the first slot 222 and is an internal slot having a rearward termination (not shown) inwardly adjacent to the distal end 224 of the shank 206 and a forward termination (not shown) generally coinciding longitudinally and axially with the upper termination 226 of the first slot 222.

In this illustrated embodiment, the shank 206 also includes a lower or first tapered portion 228 running axially from a stepped shoulder 230 adjacent the distal end 224 of the shank 206. The stepped shoulder 230 increases, or steps up, as it axially extends from a distal end portion 232 of the shank 206, adjacent the distal end 224 of the shank 206, to the lower tapered portion 228. The lower tapered portion 228 runs upwardly or axially from the stepped shoulder 230 of the shank 206 and terminates generally mid slot 222 longitudinally. The shank 206 also includes an annular shoulder 234 separating the lower tapered portion 228 from an upper or second tapered portion 236 which extends from the shoulder 234 to generally adjacent to the top of the shank 206. The annular shoulder 234 is disposed between the first tapered portion 228 and the second tapered portion 236. A diameter of the annular shoulder 234 decreases, or steps down, as it axially extends from the first tapered portion 228 to the second tapered portion 236. A generally cylindrical top portion 238 of the shank 106 extends from a position adjacent the second tapered portion 236 towards the back flange 218 that denotes the base or bottom of the nose portion 204 of the bit holder 200. The top of the shank 206 may include a rounded junction 240 (FIGS. 21 and 22) between the top portion 238 of the shank 206 and the back flange 218 of the nose portion 204 of the bit holder 200, which is provided to avoid sharp corners which may provide an area for stress cracks to begin. In other embodiments, the shank 206 may comprise different configurations, for example, the lower portion 228 and/or the upper portion 236 of the shank 206 may comprise a generally cylindrical shape, an outward taper, a slight draw angle, or a slight draft angle.

A central bore 242 axially extends from the top surface 210 of the bit holder 200 to the distal end 224 of the shank 206. The central bore 242 is adapted to receive the shank of a bit (not shown). The central bore 242 and the slot 222 allow the generally C-shaped annular sidewall of the shank 206 to radially contract when the shank is mounted in a bore 250 (FIGS. 20 and 21) of the base block 202.

The base block 202 comprises a base or mounting portion 244 and a shortened front end or bit holder receiving portion 246 opposite a base 248 of the base block 202. The shortened front end or receiving portion 246 can have an annular or generally cylindrical shape or, in a first modification of the third embodiment of the base block 202, the shortened front end or receiving portion 246 can include opposing flat sides (not shown). The base 248 can be flat or slightly concave to fit a drum or additional mounting plates, stands, or risers on which a plurality of base blocks can be mounted. The shortened receiving portion 246, in this exemplary implementation, is approximately 1½ inches in length or greater from a front face 252 of the base block 202, also corresponding to the front face of the shortened receiving portion 246, to a rear face 254 of the shortened receiving portion 246, which provides added access space of approximately ⅞ inch from the rear face 254 of the shortened receiving portion 246 to a rear 256 of the base block 202. The receiving portion 246 includes the base block bore 250 which is symmetrical with the shank 206 along a centerline and has, in this exemplary implementation, a central nominal 1½ inch diameter. The bore 250, in this exemplary implementation, is tapered and includes a countersink 258 adjacent the front face 252 of the base block 202. In other embodiments, the bore 250 may be cylindrical, generally cylindrical, inwardly tapered, outwardly tapered, or any combination thereof.

Figure 23:
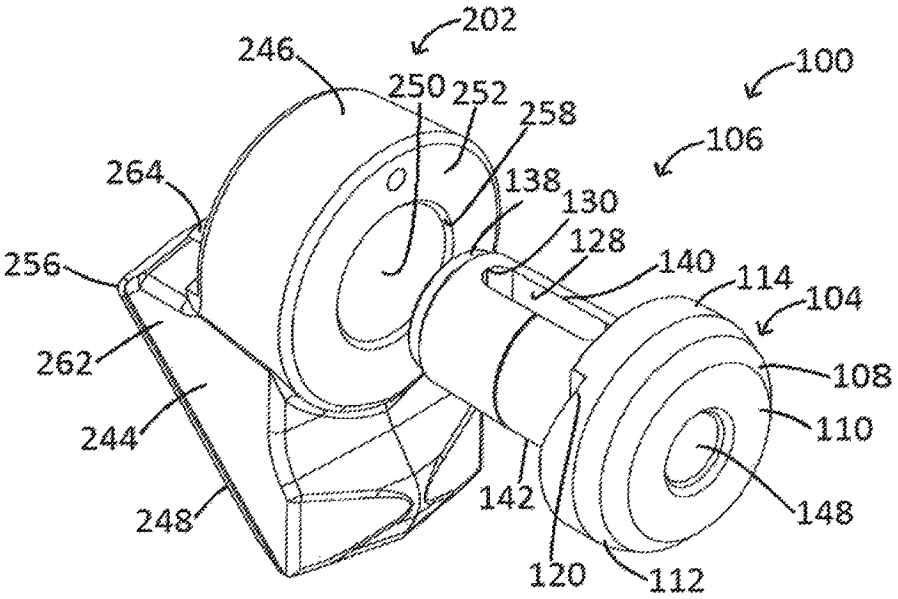
FIG. 23 is an exploded perspective view of the fifth embodiment of the bit holder and the third embodiment of the bit holder block constructed in accordance with implementations of this disclosure.
Figure 24:
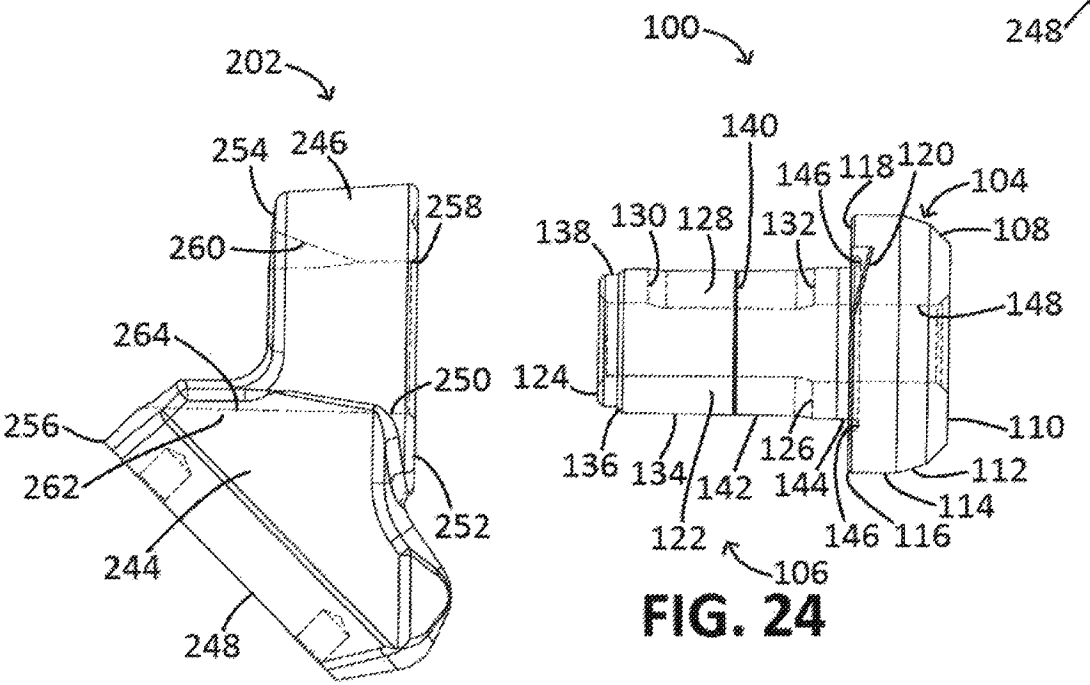
FIG. 24 is an exploded side elevation view of the fifth embodiment of the bit holder and the third embodiment of the bit holder block, showing invisible internal elements in dotted lines, constructed in accordance with implementations of this disclosure.

The rear face 254 of the shortened receiving portion 246 includes, in this embodiment, a semi cylindrical angular slot 260 at the radially outermost portion of the base block bore 250. The angular slot 260 allows added room for a drift pin or tool (not shown) to operate to drive out the bit (not shown). A portion 262 of the base block 202 includes an extension of an arcuate segment 264 of the bore 250 that extends from the rear face 254 of the shortened receiving portion 246 to a location adjacent the rear 256 of the base block 202. The arcuate segment 264 of the tapered bore 250, in this exemplary implementation, has a reduced radius from the radius of the bore 250. The bore 250 of the base block 202 is adapted to receive the shank 206 of the bit holder 200 and the bore 242 of the bit holder 200 is adapted to receive the shank of the bit (not shown). Alternatively, the bore 250 of the base block 202 is adapted to receive the shank 106 of the fifth embodiment of the bit holder 100, as shown in FIGS. 23-25.

A Seventh Illustrated Embodiment of a Bit Holder

Referring to FIGS. 26-29, a seventh embodiment of a bit holder 300 is shown. The bit holder 300 comprises a nose portion or bit holder body 302 and a generally cylindrical hollow shank 304 axially depending from a bottom of the nose portion 302. The shank 304 of the bit holder 300 of the seventh embodiment is shorter than the approximately 2¾ generally standard inch length shank of a standard bit holder which, in this exemplary implementation, the length of the shank 304 of the bit holder 300 is approximately a nominal 1¾ inches. This design can also be implemented successfully with various length shanks. The nose portion 302, in this exemplary implementation of the seventh illustrated embodiment, is generally annular in shape and comprises a frustoconical portion 306 axially extending from a top surface 308, such as a flat annular top surface, and a generally cylindrical tire portion 310 axially extending from the frustoconical portion 306. A chamfer 312 extends from a bottom of the tire portion 310 to a back flange 314, which may be generally annular.

The shank 304 includes an elongate first slot 316 extending from a distal end 318, such as a generally annular distal end, of the shank 304 axially upward or forward to an upper termination 320 near the upper or forward end of the shank 304. In another embodiment, the shank 304 can also include an internally oriented second slot (not shown) located approximately 180 degrees around the annular shank 304 from the first slot 316. This second slot can be parallel to the first slot 316 and is an internal slot having a rearward termination (not shown) inwardly adjacent to the distal end 318 of the shank 304 and a forward termination (not shown) generally coinciding longitudinally and axially with the upper termination 320 of the first slot 316.

Figure 26:
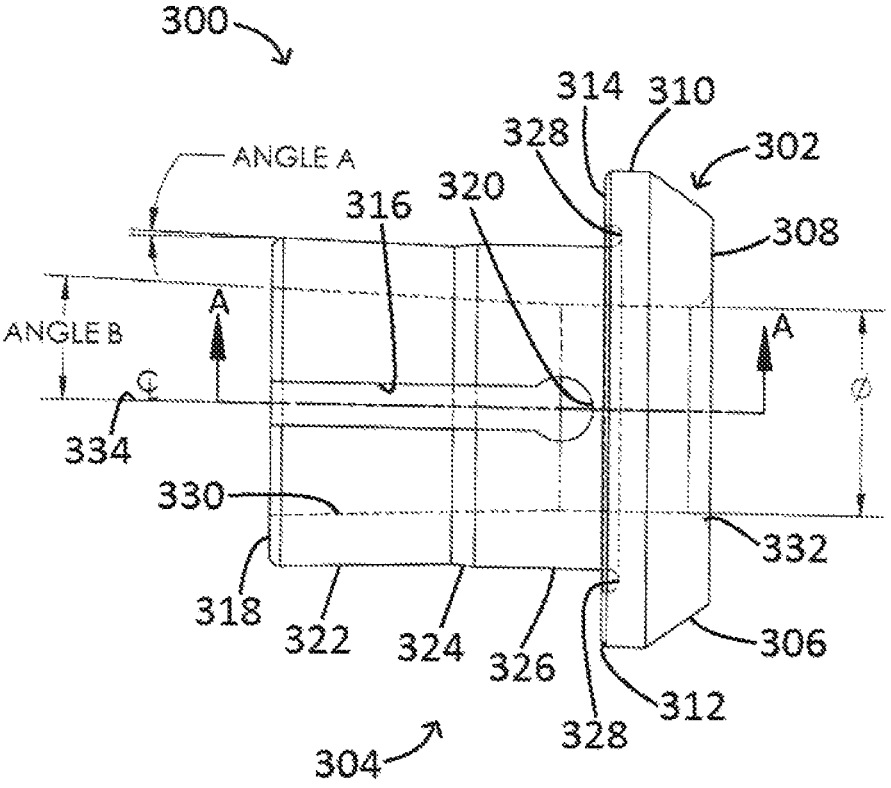
FIG. 26 is an elevation view of a seventh embodiment of a bit holder, showing invisible internal elements in dotted lines, in accordance with implementations of this disclosure.
Figure 28:
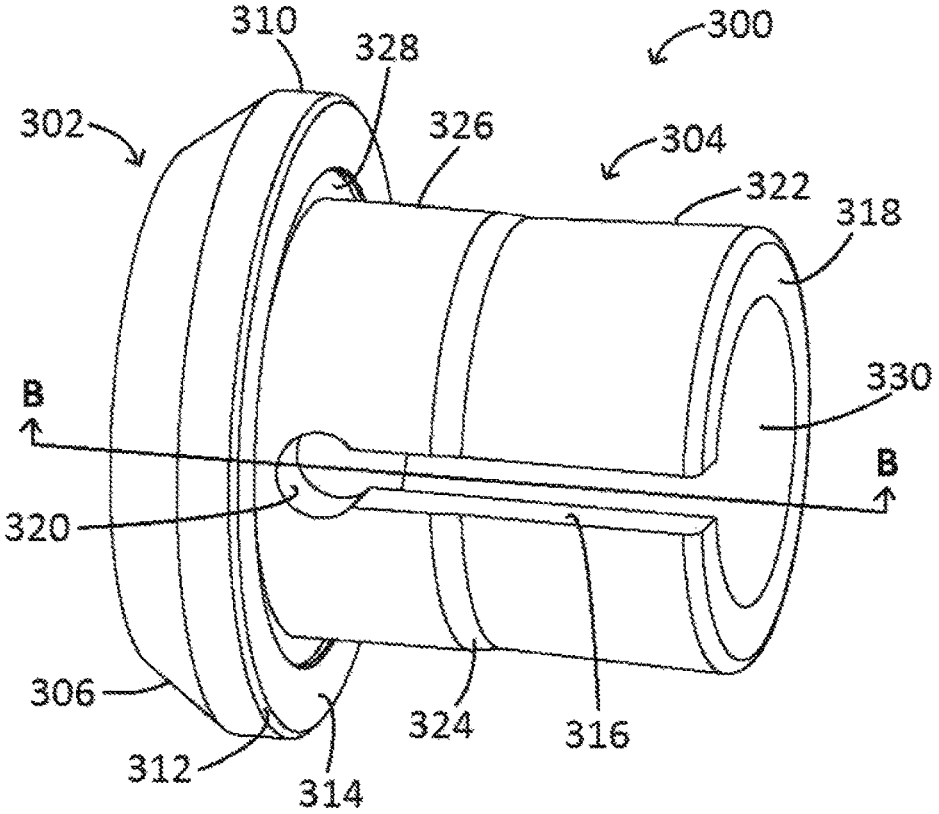
FIG. 28 is a perspective view of the seventh embodiment of the bit holder in accordance with implementation of this disclosure.
Figure 29:
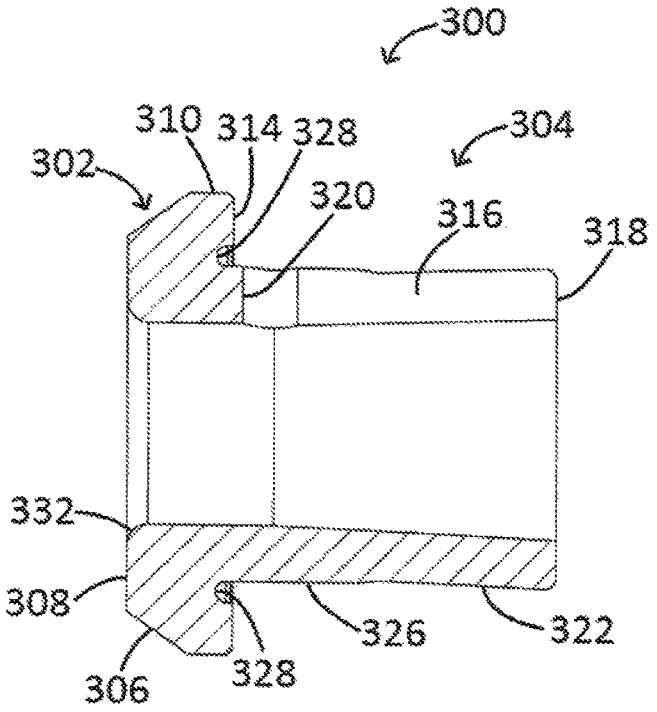
FIG. 29 is a cross-sectional view of the seventh embodiment of the bit holder, taken along centerline B-B of FIG. 28, in accordance with implementations of this disclosure.
Figure 30:
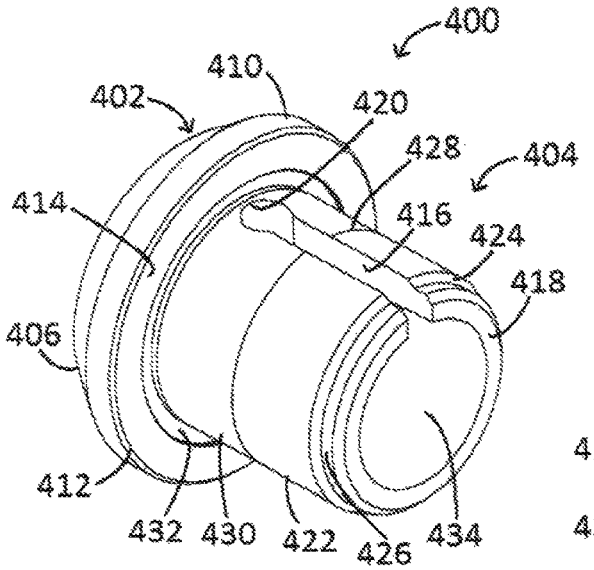
FIG. 30 is a perspective view of a first side of an eighth embodiment of a bit holder in accordance with implementations of this disclosure.
Figure 31:
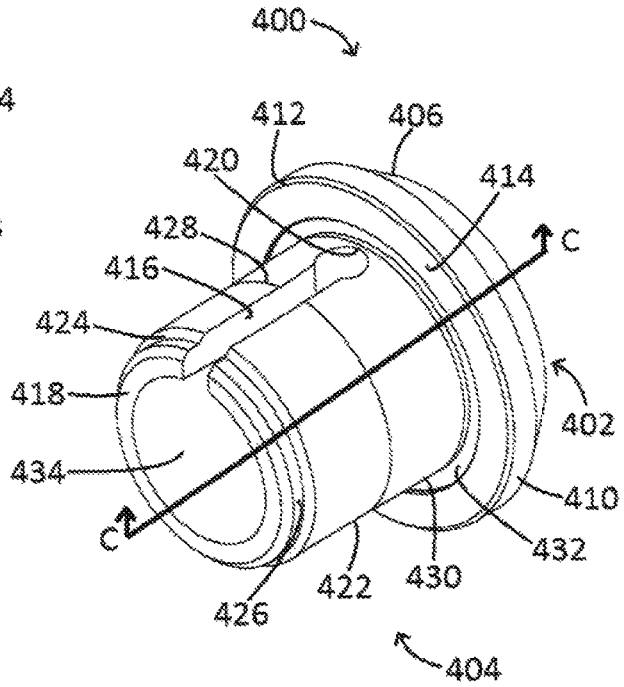
FIG. 31 is a perspective view of a second side of the eighth embodiment of the bit holder in accordance with implementations of this disclosure.
Figure 32:
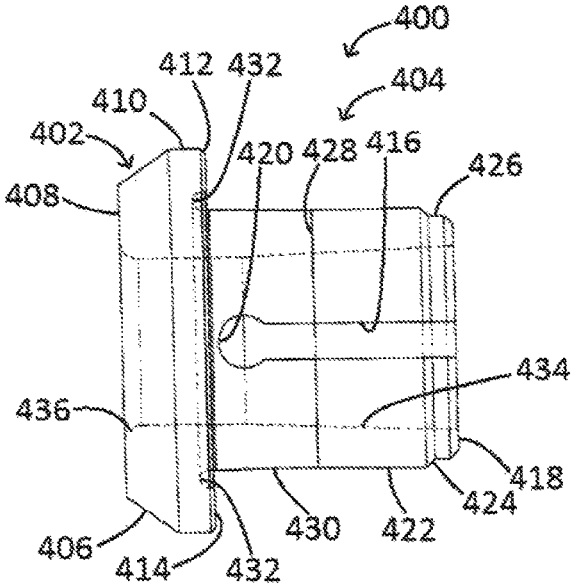
FIG. 32 is an elevation view of the eighth embodiment of the bit holder, showing invisible internal elements in dotted lines, in accordance with implementations of this disclosure.
Figure 33:
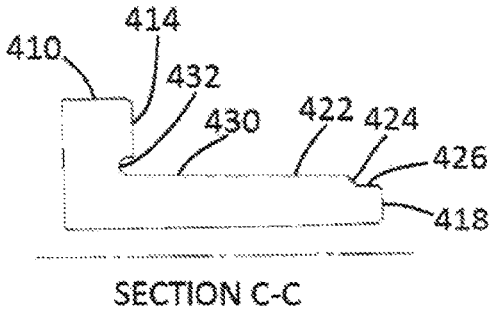
FIG. 33 is a partial cross-sectional view of the eighth embodiment of the bit holder, taken along centerline C-C of FIG. 31, in accordance with implementations of this disclosure.
Figure 34:
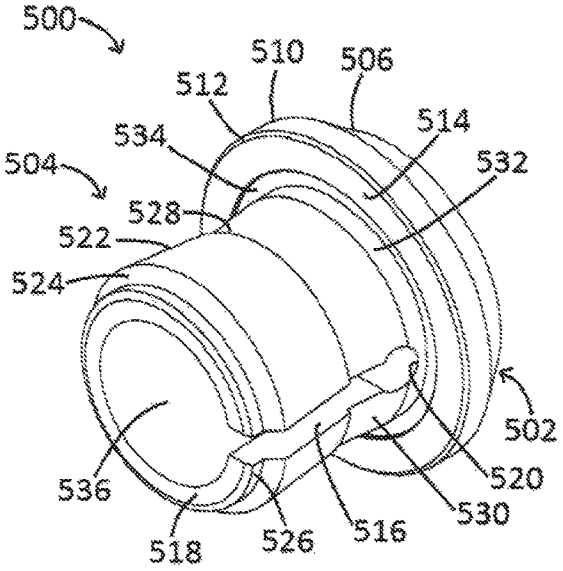
FIG. 34 is a perspective view of a first side of a ninth embodiment of a bit holder in accordance with implementations of this disclosure.
Figure 35:
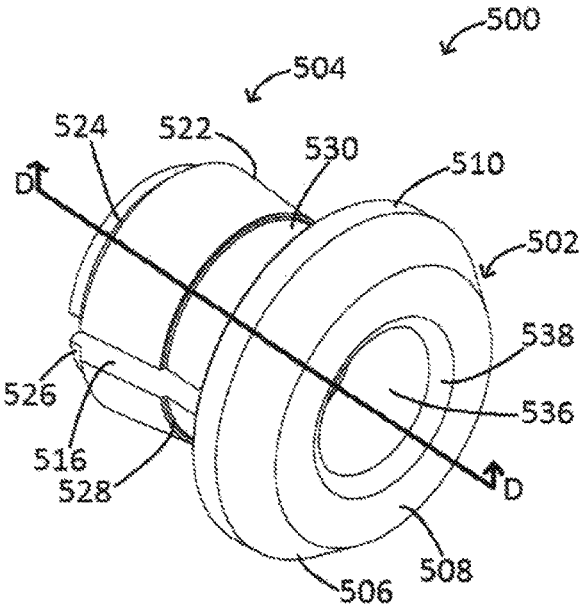
FIG. 35 is a perspective view of a second side of the ninth embodiment of the bit holder in accordance with implementations of this disclosure.
Figure 36:
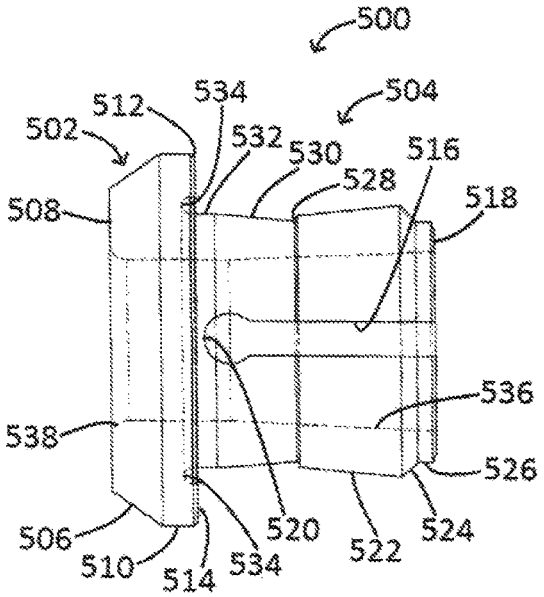
FIG. 36 is an elevation view of the ninth embodiment of the bit holder, showing invisible internal elements in dotted lines, in accordance with implementations of this disclosure.
Figure 37:
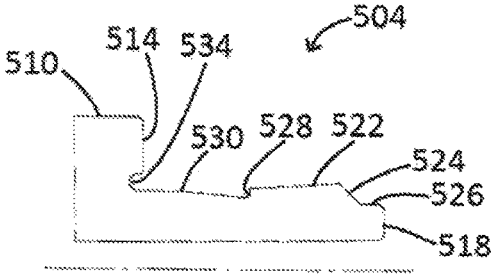
FIG. 37 is a partial cross-sectional view of the ninth embodiment of the bit holder, taken along centerline D-D of FIG. 35, in accordance with implementations of this disclosure.
Figure 38:
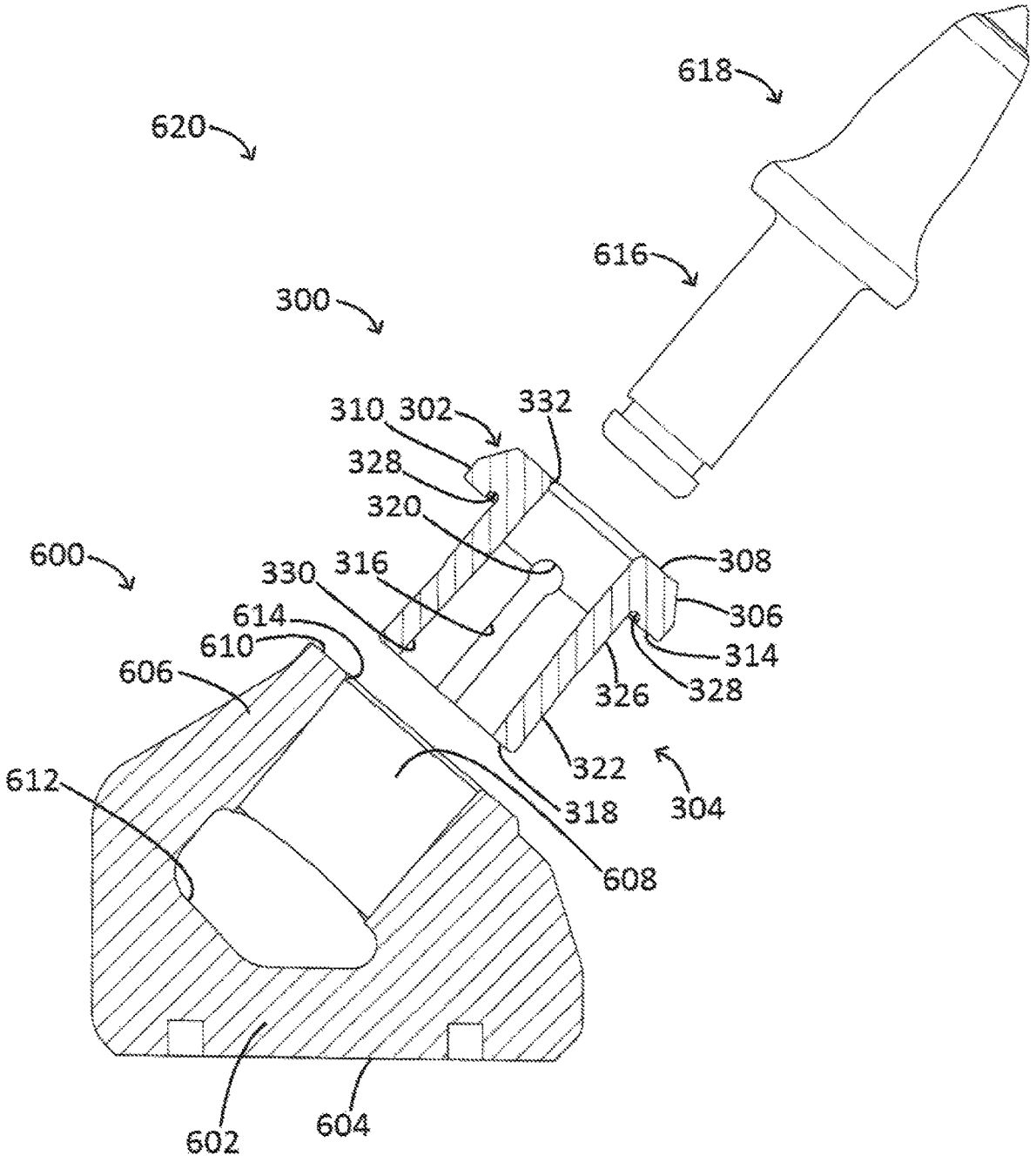
FIG. 38 is an exploded view of a bit assembly, showing an elevation view of a bit, a cross-sectional view of the seventh embodiment of the bit holder taken along line A-A of FIG. 26, and a cross-sectional view of a fourth embodiment of a bit holder block, in accordance with implementations of this disclosure.

In this illustrated embodiment, the shank 304 also includes a lower or first outwardly tapered portion 322, shown at internal Angle A in FIG. 26, adjacent the distal end 318 of the shank 304. The lower outwardly tapered portion 322 runs upwardly or axially from adjacent the distal end 318 of the shank 304 and terminates generally mid slot 316 longitudinally. The shank 304 also includes an annular shoulder 324 separating the lower outwardly tapered portion 322 from an upper or second portion 326 which extends from the shoulder 324 to generally adjacent to the top of the shank 304. The annular shoulder 324 is disposed between the first outwardly tapered portion 322 and the second portion 326. A diameter of the annular shoulder 324 decreases, or steps down, as it axially extends from the second portion 326 to the first outwardly tapered portion 322. The second portion 326 of the shank 304 extends from a position adjacent the annular shoulder 324 towards the back flange 314 that denotes the base or bottom of the nose portion 302 of the bit holder 300. The top of the shank 304 may include a rounded junction 328 between the second portion 326 of the shank 304 and the back flange 314 of the nose portion 302 of the bit holder 300, which is provided to avoid sharp corners which may provide an area for stress cracks to begin. In other embodiments, the shank 304 may comprise different configurations, for example, the lower portion 322 and/or the upper portion 326 of the shank 304 may comprise a generally cylindrical shape, an outward taper, an inward taper, a slight draw angle, or a slight draft angle.

A central bore 330 axially extends from the top surface 308 of the bit holder 300 to the distal end 318 of the shank 304 and includes a countersink 332 adjacent the top surface 308 of the bit holder 300. The central bore 330, in this illustrated embodiment, is outwardly tapered as it extends from generally mid second portion 326 to the distal end 318 of the shank 304. In this exemplary implementation, the taper of the bore 330 is at an Angle B from a centerline 334 of the central bore 330. The internal Angle A of the outwardly tapered portion 322 is a greater acute angle than the centerline 334 of the central bore 330. Internal Angle A and Angle B may be approximately the same value in this exemplary implementation. The central bore 330 is adapted to receive the shank of a bit (not shown). The central bore 242 and the slot 222 allow the generally C-shaped annular sidewall of the shank 206 to radially contract when the shank is mounted in a bore 250 (FIGS. 20 and 21) of the base block 202, and to become nearly and/or generally cylindrical at the distal end 318 of the shank 206, into which the shank 304 of the bit holder 300 is inserted and retained by outward radial force while in use. Other base block configurations can be used without deviating from the concept of this design.

A Eighth Illustrated Embodiment of a Bit Holder

Referring to FIGS. 30-33, an eighth embodiment of a bit holder 400 is shown. The bit holder 400 comprises a nose portion or bit holder body 402 and a generally cylindrical hollow shank 404 axially depending from a bottom of the nose portion 402. The shank 404 of the bit holder 400 of the eighth embodiment is shorter than the approximately 2¾ inch generally standard length shank of a standard bit holder which, in this exemplary implementation, the length of the shank 404 of the bit holder 400 is approximately a nominal 1¾ inches. This design can also be implemented successfully with various length shanks. The nose portion 402, in this exemplary implementation of the eighth illustrated embodiment, is generally annular in shape and comprises a frustoconical portion 406 axially extending from a top surface 408, such as a flat annular top surface, and a generally cylindrical tire portion 410 axially extending from the frustoconical portion 406. A chamfer 412 extends from a bottom of the tire portion 410 to a back flange 414, which may be generally annular.

The shank 404 includes an elongate first slot 416 extending from a distal end 418, such as a generally annular distal end, of the shank 404 axially upward or forward to an upper termination 420 near the upper or forward end of the shank 404. In another embodiment, the shank 404 can also include an internally oriented second slot (not shown) located approximately 180 degrees around the annular shank 404 from the first slot 416. This second slot can be parallel to the first slot 416 and is an internal slot having a rearward termination (not shown) inwardly adjacent to the distal end 418 of the shank 404 and a forward termination (not shown) generally coinciding longitudinally and axially with the upper termination 420 of the first slot 416.

In this illustrated embodiment, the shank 404 also includes a lower or first tapered portion 422 running axially from a stepped shoulder 424 adjacent the distal end 418 of the shank 404. The stepped shoulder 424 increases, or steps up, as it axially extends from a distal end portion 424 of the shank 404, adjacent the distal end 418 of the shank 404, to the lower tapered portion 422. The lower tapered portion 422 runs upwardly or axially from the stepped shoulder 424 of the shank 404 and terminates generally mid slot 416 longitudinally. The shank 404 also includes an annular shoulder 428 separating the lower tapered portion 422 from an upper or second tapered portion 430. The annular shoulder 428 is disposed between the first tapered portion 422 and the second tapered portion 430. A diameter of the annular shoulder 428 decreases, or steps down, as it axially extends from the first tapered portion 422 to the second tapered portion 428. The second tapered portion 430 of the shank 404 extends from a position adjacent the annular shoulder 428 towards the back flange 414 that denotes the base or bottom of the nose portion 402 of the bit holder 400. The top of the shank 404 may include a rounded junction 432 between the second tapered portion 430 of the shank 404 and the back flange 414 of the nose portion 402 of the bit holder 400, which is provided to avoid sharp corners which may provide an area for stress cracks to begin. In other embodiments, the shank 404 may comprise different configurations, for example, the lower portion 422 and/or the upper portion 430 of the shank 404 may comprise a generally cylindrical shape, an outward taper, an inward taper, a slight draw angle, or a slight draft angle.

A central bore 434 axially extends from the top surface 408 of the bit holder 400 to the distal end 418 of the shank 404 and includes a countersink 436 adjacent the top surface 408 of the bit holder 400. The central bore 434, in this illustrated embodiment, is outwardly tapered as it extends from generally mid second portion 428 to the distal end 418 of the shank 404, similar to the taper shown in FIG. 26. The central bore 434 is adapted to receive the shank of a bit (not shown). The central bore 434 and the slot 416 allow the generally C-shaped annular sidewall of the shank 404 to radially contract when the shank is mounted in a bore of a base block, and to become nearly and/or generally cylindrical at the distal end 418 of the shank 404 and retained by outward radial force while in use. Other base block configurations can be used without deviating from the concept of this design.

A Ninth Illustrated Embodiment of a Bit Holder

Referring to FIGS. 34-37, a ninth embodiment of a bit holder 500 is shown. The bit holder 500 comprises a nose portion or bit holder body 502 and a generally cylindrical hollow shank 504 axially depending from a bottom of the nose portion 502. The shank 504 of the bit holder 500 of the ninth embodiment is shorter than the approximately 2¾ inch generally standard length shank of a standard bit holder which, in this exemplary implementation, the length of the shank 504 of the bit holder 500 is approximately a nominal 1¾ inches. This design can also be implemented successfully with various length shanks. The nose portion 502, in this exemplary implementation of the ninth illustrated embodiment, is generally annular in shape and comprises a frustoconical portion 506 axially extending from a top surface 508, such as a flat annular top surface, and a generally cylindrical tire portion 510 axially extending from the frustoconical portion 506. A chamfer 512 extends from a bottom of the tire portion 510 to a back flange 514, which may be generally annular.

The shank 504 includes an elongate first slot 516 extending from a distal end 518, such as a generally annular distal end, of the shank 504 axially upward or forward to an upper termination 520 near the upper or forward end of the shank 504. In another embodiment, the shank 502 can also include an internally oriented second slot (not shown) located approximately 180 degrees around the annular shank 504 from the first slot 516. This second slot can be parallel to the first slot 516 and is an internal slot having a rearward termination (not shown) inwardly adjacent to the distal end 518 of the shank 504 and a forward termination (not shown) generally coinciding longitudinally and axially with the upper termination 520 of the first slot 516.

In this illustrated embodiment, the shank 504 also includes a lower or first outwardly tapered portion 522 running axially from a stepped shoulder 524 adjacent the distal end 518 of the shank 504. The stepped shoulder 524 increases, or steps up, as it axially extends from a distal end portion 526 of the shank 504, adjacent the distal end 518 of the shank 504, to the lower outwardly tapered portion 522. The lower outwardly tapered portion 522 runs upwardly or axially from the stepped shoulder 524 of the shank 504 and terminates generally mid slot 516 longitudinally. The shank 504 also includes an annular shoulder 528 separating the lower outwardly tapered portion 522 from an upper or second tapered portion 530 which extends from the shoulder 528 to generally adjacent to the top of the shank 504. The annular shoulder 528 is disposed between the first outwardly tapered portion 522 and the second tapered portion 530. A diameter of the annular shoulder 528 decreases, or steps down, as it axially extends from the first outwardly tapered portion 522 to the second tapered portion 530. A generally cylindrical top portion 532 of the shank 504 extends from a position adjacent the second tapered portion 530 towards the back flange 514 that denotes the base or bottom of the nose portion 502 of the bit holder 500. The top of the shank 504 may include a rounded junction 534 (FIGS. 34, 36, and 37) between the top portion 532 of the shank 504 and the back flange 514 of the nose portion 502 of the bit holder 500, which is provided to avoid sharp corners which may provide an area for stress cracks to begin. In other embodiments, the shank 504 may comprise different configurations, for example, the lower portion 522 and/or the upper portion 530 of the shank 504 may comprise a generally cylindrical shape, an outward taper, an inward taper, a slight draw angle, or a slight draft angle.

A central bore 536 axially extends from the top surface 508 of the bit holder 500 to the distal end 514 of the shank 504 and includes a countersink 538 adjacent the top surface 508 of the bit holder 500. The central bore 536, in this illustrated embodiment, is outwardly tapered as it extends from generally mid second portion 530 to the distal end 518 of the shank 504, similar to the taper shown in FIG. 26. The central bore 536 is adapted to receive the shank of a bit (not shown). The central bore 536 and the slot 516 allow the generally C-shaped annular sidewall of the shank 504 to radially contract when the shank is mounted in a bore of a base block, causing the shank 504 and the bore 536 to become nearly and/or generally cylindrical and retained by outward radial force while in use. Other base block configurations can be used without deviating from the concept of this design.

Figure 39:
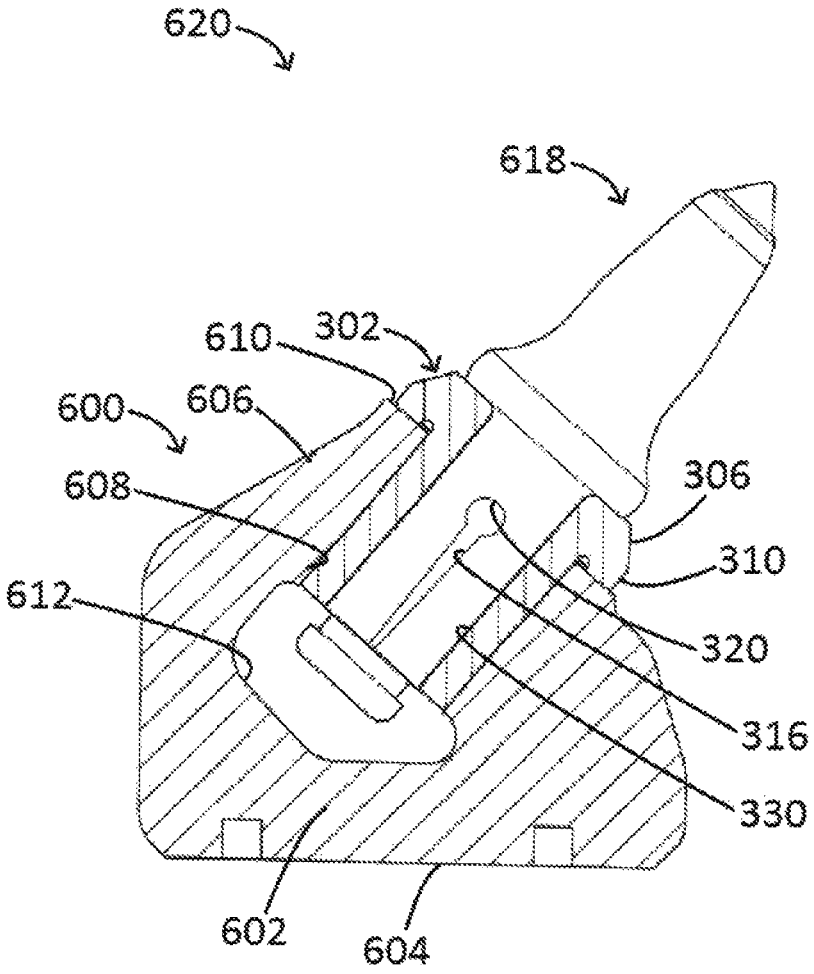
FIG. 39 is an elevation view of a bit assembled into a cross-section view of the seventh embodiment of the bit holder, taken along line A-A of FIG. 26, that is assembled into a cross-sectional view of the fourth embodiment of the bit holder block, showing the assembled bit assembly of FIG. 38, in accordance with implementations of this disclosure.

The Seventh Illustrated Embodiment of the Bit Holder and A Fourth Illustrated Embodiment of a Base Block Referring to FIGS. 38-41, the seventh embodiment of the bit holder 300, as described above, and a fourth embodiment of a base block 600 are shown. The fourth embodiment of the base block 600 comprises a base mounting portion 602 that includes a base 604 which may be flat, as shown, or slightly concave to fit on a cylindrical drum (not shown), or mounted to a stand or riser mounted on the drum, and a generally annular and/or cylindrical bit holder receiving portion 606, adjacent the base mounting portion 602 which holds the base block 600 on the drum. The receiving portion 606 includes a central bore 608 that axially extends from a front face 610 of the receiving portion 606 to a recess 612 adjacent the base 604 of the base mounting portion 602 of the base block 600. The bore 608 includes a countersink 614 adjacent the front face 610. The bore 608 of the base block 600 is adapted to receive the shank 304 of the bit holder 300 into which the shank 304 of the bit holder 300 is inserted and retained by outward radial force while in use, as shown in FIG. 39, and the bore 330 of the of the bit holder 300 is adapted to receive the shank 616 of the bit 618. Other base block configurations can be used without deviating from the concept of this design.

Figure 40:
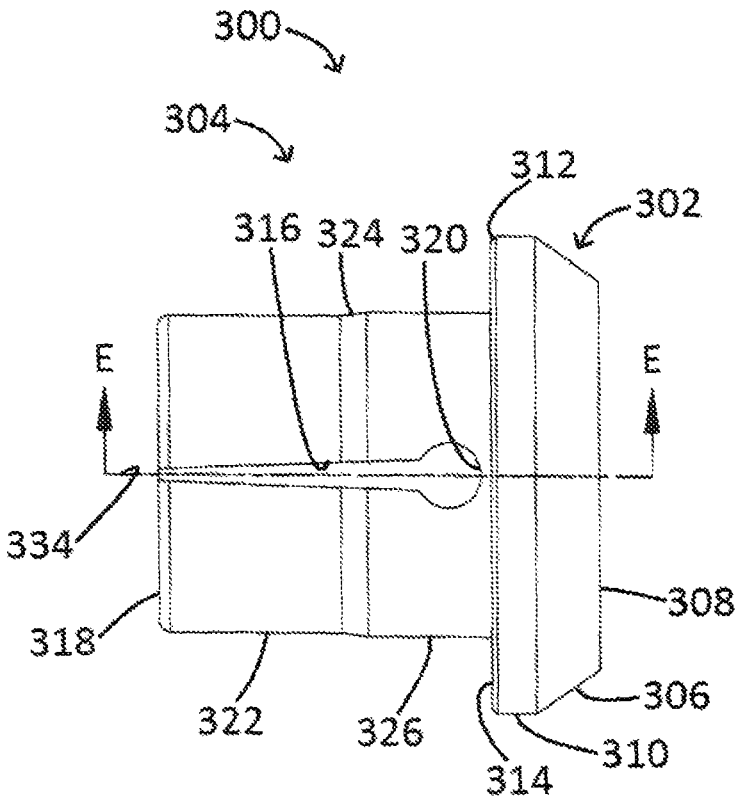
FIG. 40 is an elevation view of the seventh embodiment of the bit holder, shown in a configuration of the seventh embodiment of the bit holder once assembled into the fourth embodiment of the bit holder block, in accordance with implementations of this disclosure.
Figure 41:
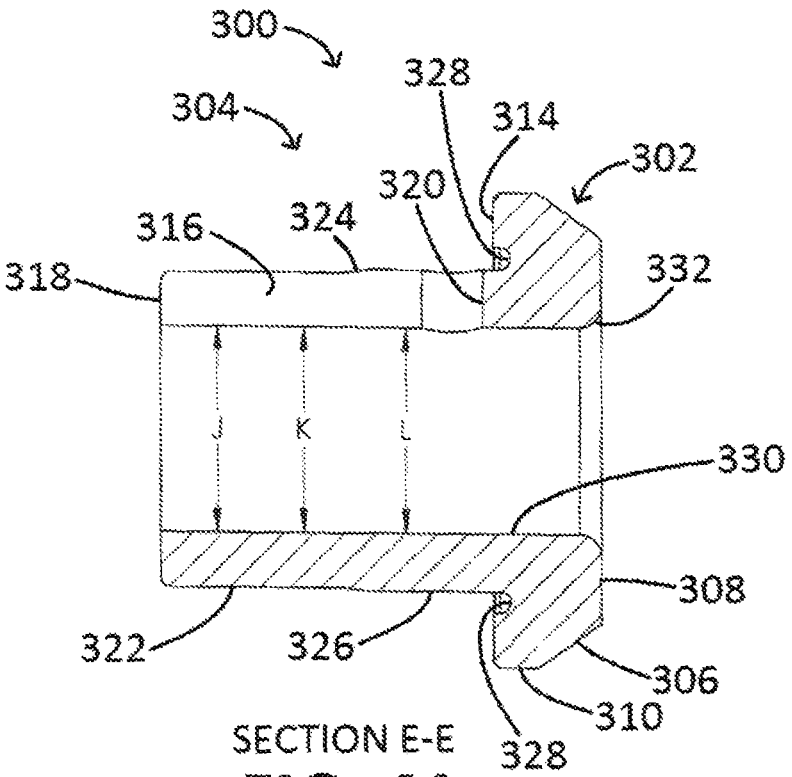
FIG. 41 is a cross-sectional view of the seventh embodiment of the bit holder taken along Line E-E of FIG. 40, shown in the configuration of the seventh embodiment of the bit holder once assembled into the fourth embodiment of the bit holder block, in accordance with implementations of this disclosure.

When in use, the central bore 330 and the slot 316 allow the generally C-shaped annular sidewall of the shank 304 to radially contract when the shank is mounted in a bore of a base block, such as the bore 608 of the base block 600, as shown in FIGS. 40 and 41. The ability of the slotted shank 304, as shown in FIG. 40, to change its shape provides for a more complete surface fit or contact between the shank 304 and the bore 608 of the base block 600. As a result, the bit holder 300 stays snugly mounted in the bore 608 of the base block 600 and prolongs the useful life of the bit assembly 620 (FIG. 39). Referring to FIG. 41, after the bit holder 300 is inserted into the bore 608 of the base block 600, the central bore 330 becomes less outwardly tapered towards the distal end 318 (shown at J, K, and L in FIG. 41) and becomes generally cylindrical and/or annular in shape.

As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, "X includes at least one of A and B" is intended to mean any of the natural inclusive permutations. That is, if X includes A; X includes B; or X includes both A and B, then "X includes at least one of A and B" is satisfied under any of the foregoing instances. The articles "a" and "an" as used in this application and the appended claims should generally be construed to mean "one or more" unless specified otherwise or clear from context to be directed to a singular form. Moreover, use of the term "an implementation" or "one implementation" throughout is not intended to mean the same embodiment, aspect or implementation unless described as such.

While the present disclosure has been described in connection with certain embodiments and measurements, it is to be understood that the present disclosure is not to be limited to the disclosed embodiments and measurements but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A bit holder comprising:

a body portion including a body axial length;

a generally cylindrical hollow shank axially depending from a bottom of the body portion, the shank including a shank axial length that is longer than the body axial length; and an outer surface of a first portion of the shank adjacent a distal end of the shank being tapered radially outwardly as it extends from generally mid shank toward the distal end.

2. The bit holder of claim 1, further comprising:

a slot through a sidewall of the shank, the slot extending from the distal end of the shank.

3. The bit holder of claim 2, further comprising:

an upper termination of the slot disposed adjacent a forward end of the shank.

4. The bit holder of claim 2, further comprising:

a reduced diameter second portion of the shank adjacent the first portion, the second portion including an upper termination of the slot.

5. The bit holder of claim 1, further comprising:

a slot through a sidewall of the shank, the slot extending from a rear location adjacent the distal end of the shank to a forward location adjacent a forward end of the shank.

6. The bit holder of claim 1, further comprising:

a bore axially extending from a forward end of the body portion to the distal end of the shank.

7. The bit holder of claim 6, further comprising:

a portion of the bore comprising a radially outward taper as the portion extends toward the distal end of the shank.

8. The bit holder of claim 6, wherein a length of the shank is based on a diameter of the bore.

9. The bit holder of claim 1, further comprising:

a length of the shank comprising one of a nominal 2¾ inch length and a shortened length, the shortened length being shorter than the nominal 2¾ inch length.

10. The bit holder of claim 9, wherein the shortened length is a nominal 1¾ inches.

11. The bit holder of claim 1, further comprising:

a second portion of the shank adjacent the first portion, the second portion comprising a radially inward taper as it extends toward the first portion.

12. The bit holder of claim 1, further comprising:

an annular interference portion adjacent a top of the shank.

13. The bit holder of claim 1, further comprising:
at least one of a diamond coated insert and a diamond tip insert affixed adjacent a top of the body.

14. The bit holder of claim 1, further comprising:
a first portion of a sidewall of the shank is angled with respect to an axis of the shank at a radially outward acute angle toward a distal end thereof.

15. The bit holder of claim 1, the shank being less than 2⅜ inches in length.

16. The bit holder of claim 1, the shank being a nominal 1½ inches in length.

17. The bit holder of claim 1, further comprising:
a reduced diameter second portion of the shank adjacent the first portion;
a generally cylindrical third portion of the shank adjacent the reduced diameter second portion; and
a shoulder disposed between the generally cylindrical third portion and the reduced diameter second portion.

18. The bit holder of claim 17, a diameter of the shoulder decreases as the shoulder axially extends from the generally cylindrical third portion to the reduced diameter second portion.

19. A combination bit holder and base block comprising:
a bit holder comprising:
a body portion including a body axial length;
a generally cylindrical hollow shank axially depending from a bottom of the body portion, the shank including a shank axial length that is longer than the body axial length; and
an outer surface of a first portion of the shank adjacent a distal end of the shank being tapered radially outwardly as it extends from generally mid shank toward the distal end; and
a base block comprising:
a base mounting portion including a base surface;
a device receiving portion integrally extending from the base mounting portion opposite the base surface; and
a base block bore extending through the device receiving portion, the base block bore adapted to receive the shank of the bit holder.

20. The combination bit holder and base block of claim 19, further comprising:
a slot through a sidewall of the shank, the slot extending from the distal end of the shank.

21. The combination bit holder and base block of claim 20, further comprising:
an upper termination of the slot disposed adjacent a forward end of the shank.

22. The combination bit holder and base block of claim 20, further comprising:
a reduced diameter second portion of the shank adjacent the first portion, the second portion including an upper termination of the slot.

23. The combination bit holder and base block of claim 19, further comprising:
a slot through a sidewall of the shank, the slot extending from a rear location adjacent the distal end of the shank to a forward location adjacent a forward end of the shank.

24. The combination bit holder and base block of claim 19, further comprising:
a bit holder bore axially extending from a forward end of the body portion to the distal end of the shank.

25. The combination bit holder and base block of claim 24, further comprising:
a portion of the bit holder bore comprising a radially outward taper as the portion extends toward the distal end of the shank.

26. The combination bit holder and base block of claim 24, wherein a length of the shank is based on a diameter of the bit holder bore.

27. The combination bit holder and base block of claim 19, further comprising:
a length of the shank comprising one of nominal 2¾ inch length and a shortened length, the shortened length being shorter than the nominal 2¾ inch length.

28. The combination bit holder and base block of claim 27, wherein the shortened length is a nominal 1¾ inches.

29. The combination bit holder and base block of claim 19, further comprising:
an axial length of the device receiving portion that is shorter than a length of the base mounting portion.

30. The combination bit holder and base block of claim 29, the base mounting portion comprising an extension of an arcuate segment of the base block bore extending past a rear of the device receiving portion to a location adjacent a rear of the base mounting portion.

31. The combination bit holder and base block of claim 30, the extension of the arcuate segment of the base block bore forms an interference fit with the first portion of the shank, wherein a length of the shank is a nominal 2¾ inches.

32. The combination bit holder and base block of claim 29, further comprising:
an angular slot extending inwardly from the rear of the device receiving portion, the angular slot enclosed within a sidewall of the device receiving portion to a position mediate a front of the device receiving portion and the rear of the device receiving portion.

33. The combination bit holder and base block of claim 29, wherein the base block bore includes an axial length of about 1½ inches and a nominal diameter of 1½ inches.

34. The combination bit holder and base block of claim 19, further comprising:
a second portion of the shank adjacent the first portion, the second portion comprising a radially inward taper as it extends toward the first portion.

35. The combination bit holder and base block of claim 19, further comprising:
an annular interference portion adjacent a top of the shank.

36. The combination bit holder and base block of claim 19, further comprising:
at least one of a diamond coated insert and a diamond tip insert affixed adjacent a top of the body.

37. The combination bit holder and base block of claim 19, further comprising:
a first portion of a sidewall of the shank is angled with respect to an axis of the shank at a radially outward acute angle toward a distal end thereof.

38. The combination bit holder and base block of claim 19, the shank being less than 2⅜ inches in length.

39. The combination bit holder and base block of claim 19, the shank being a nominal 1½ inches in length.

40. The combination bit holder and base block of claim 19, further comprising:
a reduced diameter second portion of the shank adjacent the first portion;
a generally cylindrical third portion of the shank adjacent the reduced diameter second portion; and
a shoulder disposed between the generally cylindrical third portion and the reduced diameter second portion.

41. The combination bit holder and base block of claim 40, a diameter of the shoulder decreases as the shoulder axially extends from the generally cylindrical third portion to the reduced diameter second portion.

* * * * *